US007495212B2

(12) United States Patent
Kim et al.

(10) Patent No.: US 7,495,212 B2
(45) Date of Patent: Feb. 24, 2009

(54) ION GUIDE FOR MASS SPECTROMETERS

(75) Inventors: Taeman Kim, North Billerica, MA (US); Melvin Andrew Park, Billerica, MA (US)

(73) Assignee: Bruker Daltonics, Inc., Billerica, MA (US)

( * ) Notice: Subject to any disclaimer, the term of this patent is extended or adjusted under 35 U.S.C. 154(b) by 191 days.

(21) Appl. No.: 11/418,171

(22) Filed: May 4, 2006

(65) Prior Publication Data

US 2007/0278399 A1 Dec. 6, 2007

Related U.S. Application Data

(62) Division of application No. 10/407,860, filed on Apr. 4, 2003, now abandoned.

(51) Int. Cl.
*H01J 49/42* (2006.01)

(52) U.S. Cl. ..... 250/292; 250/396 R

(58) Field of Classification Search ..... 250/292, 250/290, 287, 286, 396 R
See application file for complete search history.

(56) References Cited

U.S. PATENT DOCUMENTS

| | | | | |
|---|---|---|---|---|
| 5,572,035 | A * | 11/1996 | Franzen | 250/396 R |
| 6,107,628 | A * | 8/2000 | Smith et al. | 250/292 |
| 6,693,276 | B2 * | 2/2004 | Weiss et al. | 250/288 |
| 6,707,037 | B2 * | 3/2004 | Whitehouse | 250/288 |
| 6,727,495 | B2 * | 4/2004 | Li | 250/286 |
| 6,750,448 | B2 * | 6/2004 | Turecek et al. | 250/281 |
| 6,762,404 | B2 * | 7/2004 | Bateman et al. | 250/281 |
| 6,794,641 | B2 * | 9/2004 | Bateman et al. | 250/281 |
| 6,891,153 | B2 * | 5/2005 | Bateman et al. | 250/281 |
| 6,906,319 | B2 * | 6/2005 | Hoyes | 250/282 |

* cited by examiner

*Primary Examiner*—Kiet T Nguyen
(74) *Attorney, Agent, or Firm*—Ward & Olivo

(57) ABSTRACT

The present invention relates generally to mass spectrometry and the analysis of chemical samples, and more particularly to ion guides for use therein. The invention described herein comprises an improved method and apparatus for transporting ions from a first pressure region in a mass spectrometer to a second pressure region therein. More specifically, the present invention provides a segmented ion funnel for more efficient use in mass spectrometry (particularly with ionization sources) to transport ions from the first pressure region to the second pressure region.

24 Claims, 25 Drawing Sheets

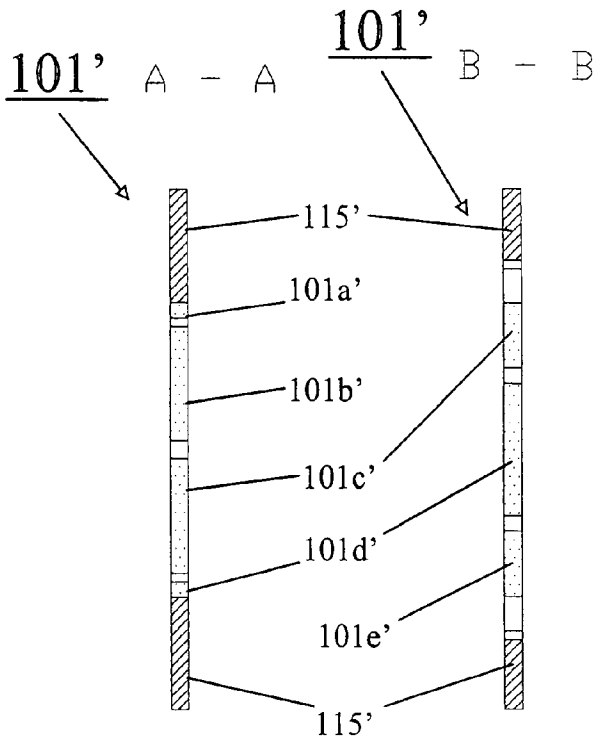
FIG. 7E
FIG. 7F
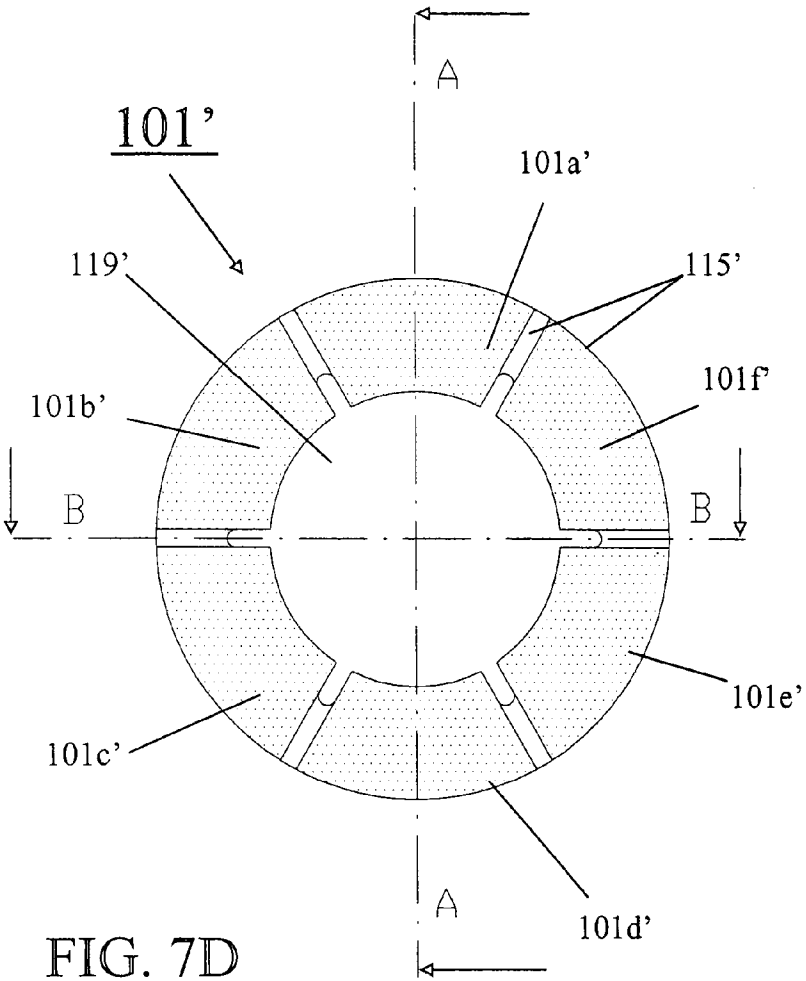
FIG. 7D

ION GUIDE FOR MASS SPECTROMETERS

CROSS REFERENCE TO RELATED APPLICATIONS

This application is a divisional of U.S. patent application Ser. No. 10/407,860, filed Apr. 4, 2003 now abandoned which is incorporated in its entirety herein by reference.

TECHNICAL FIELD OF THE INVENTION

The present invention generally relates to an improved method and apparatus for the injection of ions into a mass spectrometer for subsequent analysis. Specifically, the invention relates to an apparatus for use with an ion source that facilitate the transmission of ions from an elevated pressure ion production region to a reduced pressure ion analysis region of a mass spectrometer. A preferred embodiment of the present invention allows for improved efficiency in the transmission of ions from a relatively high pressure region, through a multitude of differential pumping stages, to a mass analyzer.

BACKGROUND OF THE INVENTION

The present invention relates to ion guides for use in mass spectrometry. The apparatus and methods for ionization described herein are enhancements of the techniques referred to in the literature relating to mass spectrometry—an important tool in the analysis of a wide range of chemical compounds. Specifically, mass spectrometers can be used to determine the molecular weight of sample compounds. The analysis of samples by mass spectrometry consists of three main steps—formation of gas phase ions from sample material, mass analysis of the ions to separate the ions from one another according to ion mass, and detection of the ions. A variety of means and methods exist in the field of mass spectrometry to perform each of these three functions. The particular combination of the means and methods used in a given mass spectrometer determine the characteristics of that instrument.

To mass analyze ions, for example, one might use magnetic (B) or electrostatic (E) analysis, wherein ions passing through a magnetic or electrostatic field will follow a curved path. In a magnetic field, the curvature of the path will be indicative of the momentum-to-charge ratio of the ion. In an electrostatic field, the curvature of the path will be indicative of the energy-to-charge ratio of the ion. If magnetic and electrostatic analyzers are used consecutively, then both the momentum-to-charge and energy-to-charge ratios of the ions will be known and the mass of the ion will thereby be determined. Other mass analyzers are the quadrupole (Q), the ion cyclotron resonance (ICR), the time-of-flight (TOF), and the quadrupole ion trap analyzers. The analyzer which accepts ions from the ion guide described here may be any of a variety of these.

Before mass analysis can begin, gas phase ions must be formed from a sample material. If the sample material is sufficiently volatile, ions may be formed by electron ionization (EI) or chemical ionization (CI) of the gas phase sample molecules. Alternatively, for solid samples (e.g., semiconductors, or crystallized materials), ions can be formed by desorption and ionization of sample molecules by bombardment with high energy particles. Further, Secondary Ion Mass Spectrometry (SIMS), for example, uses keV ions to desorb and ionize sample material. In the SIMS process a large amount of energy is deposited in the analyte molecules, resulting in the fragmentation of fragile molecules. This fragmentation is undesirable in that information regarding the original composition of the sample (e.g., the molecular weight of sample molecules) will be lost.

For more labile, fragile molecules, other ionization methods now exist. The plasma desorption (PD) technique was introduced by Macfarlane et al. (R. D. Macfarlane, R. P. Skowronski, D. F. Torgerson, *Biochem. Biophys. Res Commoun.* 60 (1974) 616)("McFarlane"). Macfarlane discovered that the impact of high energy (MeV) ions on a surface, like SIMS would cause desorption and ionization of small analyte molecules. However, unlike SIMS, the PD process also results in the desorption of larger, more labile species (e.g., insulin and other protein molecules).

Additionally, lasers have been used in a similar manner to induce desorption of biological or other labile molecules. See, for example, Cotter et al. (R. B. VanBreeman, M. Snow, R. J. Cotter, *Int. J. Mass Spectrom. Ion Phys.* 49 (1983) 35; Tabet, J. C.; Cotter, R. J., Tabet, J. C., *Anal. Chem.* 56 (1984) 1662; or R. J. Cotter, P. Demirev, I. Lys, J. K. Olthoff, J. K.; Lys, I.: Demirev, P.: Cotter et al., R. J., *Anal. Instrument.* 16 (1987) 93). Cotter modified a CVC 2000 time-of-flight mass spectrometer for infrared laser desorption of involatile biomolecules, using a Tachisto (Needham, Mass.) model 215G pulsed carbon dioxide laser. The plasma or laser desorption and ionization of labile molecules relies on the deposition of little or no energy in the analyte molecules of interest. The use of lasers to desorb and ionize labile molecules intact was enhanced by the introduction of matrix assisted laser desorption ionization (MALDI) (K. Tanaka, H. Waki, Y. Ido, S. Akita, Y. Yoshida, T. Yoshica, *Rapid Commun. Mass Spectrom.* 2 (1988) 151 and M. Karas, F. Hillenkamp, *Anal. Chem.* 60 (1988) 2299). In the MALDI process, an analyte is dissolved in a solid, organic matrix. Laser light of a wavelength that is absorbed by the solid matrix but not by the analyte is used to excite the sample. Thus, the matrix is excited directly by the laser, and the excited matrix sublimes into the gas phase carrying with it the analyte molecules. The analyte molecules are then ionized by proton, electron, or cation transfer from the matrix molecules to the analyte molecules. This process (i.e., MALDI) is typically used in conjunction with time-of-flight mass spectrometry (TOFMS) and can be used to measure the molecular weights of proteins in excess of 100,000 daltons.

Further, Atmospheric Pressure Ionization (API) includes a number of ion production means and methods. Typically, analyte ions are produced from liquid solution at atmospheric pressure. One of the more widely used methods, known as electrospray ionization (ESI), was first suggested by Dole et al. (M. Dole, L. L. Mack, R. L. Hines, R. C. Mobley, L. D. Ferguson, M. B. Alice, *J. Chem. Phys.* 49, 2240, 1968). In the electrospray technique, analyte is dissolved in a liquid solution and sprayed from a needle. The spray is induced by the application of a potential difference between the needle and a counter electrode. The spray results in the formation of fine, charged droplets of solution containing analyte molecules. In the gas phase, the solvent evaporates leaving behind charged, gas phase, analyte ions. This method allows for very large ions to be formed. Ions as large as 1 MDa have been detected by ESI in conjunction with mass spectrometry (ESMS).

In addition to ESI, many other ion production methods might be used at atmospheric or elevated pressure. For example, MALDI has recently been adapted by Laiko et al. to work at atmospheric pressure (Victor Laiko and Alma Burlingame, "Atmospheric Pressure Matrix Assisted Laser Desorption", U.S. Pat. No. 5,965,884, and Atmospheric Pressure Matrix Assisted Laser Desorption Ionization, poster #1121, $4^{th}$ International Symposium on Mass Spectrometry in the Health and Life Sciences, San Francisco, Aug. 25-29, 1998) and by Standing et al. at elevated pressures (Time of Flight Mass Spectrometry of Biomolecules with Orthogonal Injection+Collisional Cooling, poster #1272, 4th International Symposium on Mass Spectrometry in the Health and Life Sciences, San Francisco, Aug. 25-29, 1998; and Orthogonal Injection TOFMS *Anal. Chem.* 71(13), 452A (1999)). The benefit of adapting ion sources in this manner is that the ion optics (i.e., the electrode structure and operation) in the mass analyzer and mass spectral results obtained are largely independent of the ion production method used.

The elevated pressure MALDI source disclosed by Standing differs from what is disclosed by Laiko et al. Specifically, Laiko et al. disclose a source intended to operate at substantially atmospheric pressure. In contrast, as depicted in FIG. 1, the source 1 disclosed by Standing et al. is intended to operate at a pressure of about 70 mtorr. In addition, as shown in FIG. 1, the MALDI sample resides on the tip 6 of a MALDI probe 2 in the second pumping stage 3 immediately in front of the first of two quadrupole ion guides 4. Using a laser 7, ions are desorbed from the MALDI sample directly into 70 mTorr of gas and are immediately drawn into the ion guides 4 by the application of an electrostatic field. Even though this approach requires that one insert the sample into the vacuum system, it has the advantage of improved ion transmission efficiency over that of the Laiko source. That is, the possible loss of ions during transmission from the elevated pressure source 1, operated at atmospheric pressure, to the third pumping region and the ion guide therein is avoided because the ions are generated directly in the second pumping stage.

Elevated pressure (i.e., elevated relative to the pressure of the mass analyzer) and atmospheric pressure ion sources always have an ion production region, wherein ions are produced, and an ion transfer region, wherein ions are transferred through differential pumping stages and into the mass analyzer. Generally, mass analyzers operate in a vacuum between $10^{-4}$ and $10^{-10}$ torr depending on the type of mass analyzer used. When using, for example, an ESI or elevated pressure MALDI source, ions are formed and initially reside in a high pressure region of "carrier" gas. In order for the gas phase ions to enter the mass analyzer, the ions must be separated from the carrier gas and transported through the single or multiple vacuum stages.

As a result, the use of multipole ion guides has been shown to be an effective means of transporting ions through a vacuum system. Publications by Olivers et al. (Anal. Chem, Vol. 59, p. 1230-1232, 1987), Smith et al. (Anal. Chem. Vol. 60, p. 436-441, 1988) and Douglas et al. (U.S. Pat. No. 4,963,736) have reported the use of AC-only quadrupole ion guides to transportions from an API source to a mass analyzer.

In the prior art, according to Douglas et al., as depicted in FIG. 2, ionization chamber 17 is connected to curtain gas chamber 24 via opening 18 in curtain gas plate 23. Curtain gas chamber 24 is connected by orifice 25 of orifice plate 29 to first vacuum chamber 44 that is pumped by vacuum pump 31. Vacuum chamber 44 contains a set of four AC-only quadrupole mass spectrometer rods 33. Also, the vacuum chamber 44 is connected by interchamber orifice 35 in separator plate 37 to a second vacuum chamber 51 pumped by vacuum pump 39. Chamber 51 contains a set of four standard quadrupole mass spectrometer rods 41.

An inert curtain gas, such as nitrogen, argon or carbon dioxide, is supplied via a curtain gas source 43 and duct 45 to the curtain gas chamber 24. (Dry air may also be used in some cases.) The curtain gas flows through orifice 25 into the first vacuum chamber 44 and also flows into the ionization chamber 17 to prevent air and contaminants in chamber 17 from entering the vacuum system. Excess sample, and curtain gas, leave the ionization chamber 17 via outlet 47.

Ions produced in the ionization chamber 17 are drifted by appropriate DC potentials on plates 23 and 29 and on the AC-only rod set 33 through opening 18 and orifice 25, and then are guided through the AC-only rod set 33 and interchamber orifice 35 into the rod set 41. An AC RF voltage (typically at a frequency of about 1 Megahertz) is applied between the rods of rod set 33, as is well known, to permit rod set 33 to perform its guiding and focusing function. Both DC and AC RF voltages are applied between the rods of rod set 41, so that rod set 41 performs its normal function as a mass filter, allowing only ions of selected mass to charge ratio to pass therethrough for detection by ion detector 49.

Douglas et al. found that under appropriate operating conditions, an increase in the gas pressure in the first vacuum chamber 44 not only failed to cause a decrease in the ion signal transmitted through orifice 35, but in fact most unexpectedly caused a considerable increase in the transmitted ion signal. In addition, under appropriate operating conditions, it was found that the energy spread of the transmitted ions was substantially reduced, thereby greatly improving the ease of analysis of the transmitted ion signal. The particular "appropriate operating conditions" disclosed by Douglas et al. maintain the second vacuum chamber 51 at low pressure (e.g. 0.02 millitorr or less) but the product of the pressure in the first chamber 44 and the length of the AC-only rods 33 is held above $2.25\times10^{-2}$ torr-cm, preferably between $6\times10^{-2}$ and $15\times10^{-2}$ torr-cm, and the DC voltage between the inlet plate 29 and the AC-only rods 33 is kept low (e.g., between 1 and 30 volts) preferably between 1 and 10 volts.

As shown in FIG. 3, mass spectrometers similar to that of Whitehouse et al. ("Multipole Ion Guide for Mass Spectrometry", U.S. Pat. No. 5,652,427) use multipole RF ion guides 42 to transfer ions from one pressure region 30 to another 34 in a differentially pumped system. In this ion source, ions are produced by ESI or APCI at substantially atmospheric pressure. These ions are transferred from atmospheric pressure to a first differential pumping region by the gas flow through a glass capillary 60. Further, ions are transferred from this first pumping region 30 to a second pumping region 32 through a "skimmer" 56 by gas flow as well as an electric field present between these regions. Multipole ion guide 42 in the second differentially pumped region 32 accepts ions of a selected mass/charge (m/z) ratio and guides them through a restriction and into a third differentially pumped region 34 by applying AC and DC voltages to the individual poles of the ion guide 42.

Further, as depicted in FIG. 3, a four vacuum stage ESI-reflectron-TOF mass spectrometer, according to Whitehouse et al., incorporates a multipole ion guide 42 beginning in one vacuum pumping stage 32 and extending contiguously into an adjacent pumping stage 34. As shown here, ions are formed from sample solution by an electrospray process. Sample bearing liquid is introduced through the electrospray needle 26 and is electrosprayed or nebulization-assisted electrosprayed into chamber 28 as it exits the needle tip 27 producing charged droplets. The charged droplets evaporate and desorb gas phase ions both in chamber 28 and as they are swept into the vacuum system through the annulus 38 in capillary 60. According to the prior art system shown in FIG. 3, capillary 60 is used to transportions from chamber 28, where the ions are formed, to first pumping region 30. A portion of the ions that enter the first vacuum stage 30 through the capillary exit 40 are focused through the orifice 58 in skimmer 56 with the help of lens 62 and the potential set on the capillary exit 40.

Ions passing through orifice 58 enter the multipole ion guide 42, which begins in vacuum pumping stage 32 and extends unbroken into vacuum stage 34. According to Whitehouse et al. the RF only ion guide 42 is a hexapole. The electrode rods of such prior art multipole ion guides are positioned parallel and are equally spaced at a common radius from the centerline of the ion guide. A high voltage RF potential is applied to the electrode rods of the ion guide so as to push the ions toward the centerline of the ion guide. Ions with a m/z ratio that fall within the ion guide stability window established by the applied voltages have stable trajectories within the ion guide's internal volume bounded by the evenly-spaced, parallel rods. This is true for quadrupoles, hexapoles, octapoles, or any other multipole used to guide ions. As previously disclosed by Douglas et al., operating the ion guide in an appropriate pressure range results in improved ion transmission efficiency.

Whitehouse et al. further disclose that collisions with the gas reduces the ion kinetic energy to that of the gas (i.e., room temperature). This hexapole ion guide 42 is intended to provide for the efficient transport of ions from one location (i.e., the entrance 58 of skimmer 56) to a second location (i.e., orifice 50). Of particular note is that a single contiguous multipole 42 resides in more than one differential pumping stage and guides ions through the pumping restriction between them. Compared to other prior art designs, this offers improved ion transmission through pumping restrictions.

If the multipole ion guide AC and DC voltages are set to pass ions falling within a range of m/z then ions within that range that enter the multipole ion guide 42 will exit at 46 and be focused with exit lens 48 through the TOF analyzer entrance orifice 50. The primary ion beam 82 passes between electrostatic lenses 64 and 68 that are located in the fourth pumping stage 36. The relative voltages on lenses 64, 68 and 70 are pulsed so that a portion of the ion beam 82 falling in between lenses 64 and 68 is ejected as a packet through grid lens 70 and accelerated down flight tube 80. The ions are steered by x and y lens sets diagrammatically illustrated by 72 as they continue moving down flight tube 80. As shown in this illustrative configuration, the ion packet is reflected through a reflectron or ion mirror 78, steered again by x and y lens sets illustrated by 76 and detected at detector 74. As a pulsed ion packet proceeds down flight tube 80, ions with different m/z separate in space due to their velocity differences and arrive at the detector at different times. Moreover, the use of orthogonal pulsing in an API/TOF system helps to reduce the ion energy spread of the initial ion packet allowing for the achievement of higher resolution and sensitivity.

In U.S. Pat. No. 6,011,259 Whitehouse et al. also disclose trapping ions in a multipole ion guide and subsequently releasing them to a TOF mass analyzer. In addition, Whitehouse et al. disclose ion selection in such a multipole ion guide, collision induced dissociation of selected ions, and release of the fragment ions thus produced to the TOF mass analyzer. Further, the use of two or more ion guides in consecutive vacuum pumping stages allowing for different DC and RF values is also disclosed by Whitehouse et al. However, losses in ion transmission efficiency may occur in the region of static voltage lenses between ion guides. For example, a commercially available API/MS instrument manufactured by Hewlett Packard incorporates two skimmers and an ion guide. An interstage port (also called a drag stage port) is used to pump the region between the skimmers. That is, an additional pumping stage/region is added without the addition of an extra turbo pump, thereby improving pumping efficiency. In this dual skimmer design, there is no ion focusing device between skimmers, therefore ion losses may occur as the gases are pumped away. A second example is demonstrated by a commercially available API/MS instrument manufactured by Finnigan which applies an electrostatic lens between capillary and skimmer to focus the ion beam. Due to a narrow mass range of the static lens, the instrument may need to scan the voltage to optimize the ion transmission.

According to Thomson et al. (entitled "Quadrupole with Axial DC Field", U.S. Pat. No. 6,111,250), a quadrupole mass spectrometer contains four rod sets, referred to as Q0, Q1, Q2 and Q3. A rod set is constructed to create an axial field (e.g., a DC axial field) thereon. The axial field can be created by tapering the rods, or arranging the rods at angles with respect to each other, or segmenting the rods as depicted in FIG. 4. When the axial field is applied to Q0 in a tandem quadrupole set, it speeds passage of ions through Q0 and reduces delay caused by the need to refill Q0 with ions when jumping from low to high mass in Q1. When used as collision cell Q2, the axial field reduces the delay needed for daughter ions to drain out of Q2. The axial field can also be used to help dissociate ions in Q2, either by driving the ions forwardly against the collision gas, or by oscillating the ions axially within the collision cell.

One such prior art device disclosed by Thomson et al. is depicted in FIG. 4, which shows a quadrupole rod set 96 consisting of two pair of parallel cylindrical rod sets 96A and 96B arranged in the usual fashion but divided longitudinally into six segments 96A-1 to 96A-6 and 96B-1 to 96B-6. The gap 98 between adjacent segments or sections is very small (e.g., about 0.5 mm). Each A section and each B section is supplied with the same RF voltage from RF generator, via isolating capacitors C3, but each is supplied with a different DC voltage V1 to V6 via resistors R1 to R6. Thus, sections 96A-1, 96B-1 receive voltage V1, sections 96A-2, 96B-2 receive voltage V2, and so on. This produces a stepped voltage along the central longitudinal axis 100 of the rod set 96. Connection of the R-C network and thus the voltage applied to sections 96B-1 to 96B-6 are not separately shown. The separate potentials can be generated by separate DC power supplies for each section or by one power supply with a resistive divider network to supply each section. The step wise potential produces an approximately constant axial field. While more sections over the same length will produce a finer step size and a closer approximation to a linear axial field, it is found that using six sections as shown produces good results.

For example, such a segmented quadrupole was used to transmit ions from an atmospheric pressure ion source into a downstream mass analyzer. The pressure in the quadrupole was 8.0 millitorr. Thomson et al. found that at high pressure without an axial field the ions of a normal RF quadrupole at high pressure without an axial field can require several tens of milliseconds to reach a steady state signal. However, with the use of an axial field that keeps the ions moving through the segmented quadrupole, the recovery or fill-up time of segmented quadrupoles, after a large change in RF voltage, is much shorter.

In a similar manner Wilcox et al. (B. E. Wilcox, J. P. Quinn, M. R. Emmett, C. L. Hendrickson, and A. Marshall, Proceedings of the 50$^{th}$ ASMS Conference on Mass Spectrometry and Allied Topics, Orlando, Fla., Jun. 2-6, 2002) demonstrated the use of a pulsed electric field to eject ions from an octapole ion guide. Wilcox et al. found that the axial electric field caused ions in the octapole to be ejected more quickly. This resulted in an increase in the effective efficiency of transfer of ions from the octapole to their mass analyzer by as much as a factor of 14.

Another type of prior art ion guide, depicted in FIG. 5, is disclosed by Franzen et al. in U.S. Pat. No. 5,572,035, entitled "Method and Device for the Reflection of Charged Particles on Surfaces". According to Franzen et al., the ion guide 11 comprises a series of parallel rings 12, each ring having a phase opposite that of its two neighboring rings. Thus, along the axis there exists a slightly undulating structure of the pseudo potential, slightly obstructive for a good and smooth guidance of ions. On the other hand, the diffuse reflection of particles at the cylinder wall is favorable for a fast thermalization of the ion's kinetic energy if the ions are shot about axially into the cylinder. This arrangement generates, in each of the ring centers, the well-known potential distribution of ion traps with their characteristic equipotential surfaces crossing in the center with angles of $\alpha=2\arctan(\frac{1}{2}^{0.5})$. The quadrupole fields, however, are restricted to very small areas around each center. In the direction of the cylinder axis, the pseudo potential wells of the centers are shallow because the traps follow each other in narrow sequence. In general, the pseudo potential wells are less deep the closer the rings are together. Emptying this type of ion guide by simply letting the ions flow out leaves some ions behind in the shallow wells.

In this prior art ion guide according to Franzen, an axial DC field is used to drive the ions out, ensuring that the ion guide is completely emptied. The electric circuits needed to generate this DC field are shown in FIG. 5. As shown, the RF voltage is supplied to the ring electrodes 12 via condensers, and the rings are connected by a series of resistance chokes 14 forming a resistive voltage divider for the DC voltage, and hindering the RF from flowing through the voltage divider. The DC current is switchable, and the DC field helps to empty the device of any stored ions. With rings 12 being approximately five millimeters in diameter, resistance chokes 14 of 10 microhenries and 100 Ohms, and capacitors 16 of 100 picofarads build up the desired DC fields. Fields of a few volts per centimeter are sufficient.

A similar means for guiding ions at "near atmospheric" pressures (i.e., pressures between $10^{-1}$ millibar and 1 bar) is disclosed by Smith et al. in U.S. Pat. No. 6,107,628, entitled "Method and Apparatus for Directing Ions and Other Charged Particles Generated at Near Atmospheric Pressures into a Region Under Vacuum". One embodiment, illustrated in FIG. 6, consists of a plurality of elements, or rings 13, each element having an aperture, defined by the ring inner surface 20. At some location in the series of elements, each adjacent aperture has a smaller diameter than the previous aperture, the aggregate of the apertures thus forming a "funnel" shape, otherwise known as an ion funnel. The ion funnel thus has an entry, corresponding with the largest aperture 21, and an exit, corresponding with the smallest aperture 22. According to Smith et al., the rings 13 containing apertures 20 may be formed of any sufficiently conducting material. Preferably, the apertures are formed as a series of conducting rings, each ring having an aperture smaller than the aperture of the previous ring. Further, an RF voltage is applied to each of the successive elements so that the RF voltages of each successive element is 180 degrees out of phase with the adjacent element(s), although other relationships for the applied RF field would likely be appropriate. Under this embodiment, a DC electrical field is created using a power supply and a resistor chain to supply the desired and sufficient voltage to each element to create the desired net motion of ions through the funnel.

Each of the ion guide devices mentioned above in the prior art have their own particular advantages and disadvantages. For example, the "ion funnel" disclosed by Smith et al. has the advantage that it can efficiently transmit ions through a relatively high pressure region (i.e., >0.1 mbar) of a vacuum system, whereas multipole ion guides perform poorly at such pressures. However, the ion funnel disclosed by Smith et al. performs poorly at lower pressures where multipole ion guides transmit ions efficiently. In addition, this ion funnel has a narrow range of effective geometries. That is, the thickness of the plates and the gap between the plates must be relatively small compared to the size of the aperture in the plate. Otherwise, ions may get trapped in electrodynamic "wells" in the funnel and therefore not be efficiently transmitted.

Similarly, the ion guide disclosed by Franzen et al. and shown in FIG. 5 must have apertures which are large relative to plate thickness and gap. Also while Franzen et al's ion guide can have an "axial" DC electric field to push the ions towards the exit, the DC field cannot be changed rapidly or switched on or off quickly. That is, the speed with which the DC field is switched must be much slower than that represented by the frequency of the RF potential applied to confine the ions. Similarly, the segmented quadrupole of Thomson et al. allows for an axial DC electric field. However, in Thomson et al., the field cannot be rapidly switched.

As discussed below, the ion guide according to the present invention overcomes many of the limitations of prior art ion guides. The ion guide disclosed herein provides a unique combination of attributes making it more suitable for use in the transport of ions from high pressure ion production regions to low pressure mass analyzers.

SUMMARY OF THE INVENTION

The present invention relates generally to mass spectrometry and the analysis of chemical samples, and more particularly to ion guides for use therein. The invention described herein comprises an improved method and apparatus for transporting ions from a first pressure region in a mass spectrometer to a second pressure region therein. More specifically, the present invention provides a segmented ion funnel for more efficient use in mass spectrometry, particularly with ionization sources, to transportions from the first pressure region to a second pressure region.

In light of the above described inadequacies in the prior art, a primary aspect of the present invention is to provide a means and method for efficiently guiding ions in and through high (i.e., >=0.1 mbar) and low (i.e., <=0.1 mbar) pressure regions of a mass spectrometer. Whereas, some prior art devices function well at high pressures and other devices function well at low pressures, the ion guide according to the present invention functions efficiently at both high and low pressures. It is therefore also considered another aspect of the present invention to provide an ion funnel device which begins in one pumping region and ends in another pumping region and guides ions through a pumping restriction between the two regions. The first of said pumping regions may be a relatively high pressure (i.e., >0.1 mbar) region whereas subsequent pumping regions are lower pressure.

It is another aspect of the present invention to provide a means and method for rapidly ejecting ions from an ion guide. Ions may initially be trapped, for example in a stacked ring ion guide, and then ejected from the guide as a pulse of ions. Ejection is effected by applying a pulsed electric potential to "DC electrodes" so as to force ions towards the exit end of the ion guide. Ions might be ejected into a mass analyzer or into some other device—e.g. a collision cell.

It is yet a further aspect of the present invention to provide a means and method for performing tandem mass spectrometry experiments. Particularly, a device according to the present invention might be used as a "collision cell" as well as an ion guide. When used in combination with an upstream mass analyzer, selected ions can be caused to form fragment ions. Further, a "downstream" mass analyzer may be used to analyze fragment ions thus formed. Therefore in combination with appropriate mass analyzers a fragment ion (or MS/MS) spectrum can be obtained. Alternatively, as discussed by Hofstadler et al. ("Methods and Apparatus for External Accumulation and Photodissociation of Ions Prior to Mass Spectrometric Analysis", U.S. Pat. No. 6,342,393) the ion guide might operate at a predetermined pressure such that ions in the guide can be irradiated with light and thereby caused to form fragment ions for subsequent mass analysis.

It is yet a further aspect of the present invention to provide a means and method for accepting and guiding ions from a multitude of ion production means. As described above, a number of means and methods for producing ion are known in the prior art. An ion guide according to the present invention may accept ions simultaneously from more than one such ion production means. For example, an elevated pressure MALDI ion production means may be used in combination with an ESI or other API ion production means to accept ions either simultaneously or consecutively. Importantly, the ion production means need not be physically exchanged in order to switch between them. That is, for example, one need not dismount the MALDI means and mount an ESI means in its place to switch from MALDI to ESI.

Other objects, features, and characteristics of the present invention, as well as the methods of operation and functions of the related elements of the structure, and the combination of parts and economies of manufacture, will become more apparent upon consideration of the following detailed description with reference to the accompanying drawings, all of which form a part of this specification.

BRIEF DESCRIPTION OF THE DRAWINGS

A further understanding of the present invention can be obtained by reference to a preferred embodiment set forth in the illustrations of the accompanying drawings. Although the illustrated embodiment is merely exemplary of systems for carrying out the present invention, both the organization and method of operation of the invention, in general, together with further objectives and advantages thereof, may be more easily understood by reference to the drawings and the following description. The drawings are not intended to limit the scope of this invention, which is set forth with particularity in the claims as appended or as subsequently amended, but merely to clarify and exemplify the invention.

For a more complete understanding of the present invention, reference is now made to the following drawings in which:

FIG. 7D depicts a "segmented" electrode ring according to the present invention which, in this example, includes six electrically conducting segments;

FIG. 7E is a cross-sectional view of the segmented electrode of FIG. 7D formed at line A-A;

FIG. 7F is a cross-sectional view of the segmented electrode of FIG. 7D formed at line B-B;

DETAILED DESCRIPTION OF A PREFERRED EMBODIMENT

As required, a detailed illustrative embodiment of the present invention is disclosed herein. However, techniques, systems and operating structures in accordance with the present invention may be embodied in a wide variety of sizes, shapes, forms and modes, some of which may be quite different from those in the disclosed embodiment. Consequently, the specific structural and functional details disclosed herein are merely representative, yet in that regard, they are deemed to afford the best embodiment for purposes of disclosure and to provide a basis for the claims herein which define the scope of the present invention.

The following presents a detailed description of a preferred embodiment of the present invention, as well as some alternate embodiments of the invention. As discussed above, the present invention relates generally to the mass spectroscopic analysis of chemical samples and more particularly to mass spectrometry. Specifically, an apparatus and method are described for the transport of ions within and between pressure regions within a mass spectrometer. Reference is herein made to the figures, wherein the numerals representing particular parts are consistently used throughout the figures and accompanying discussion.

Figure 1:
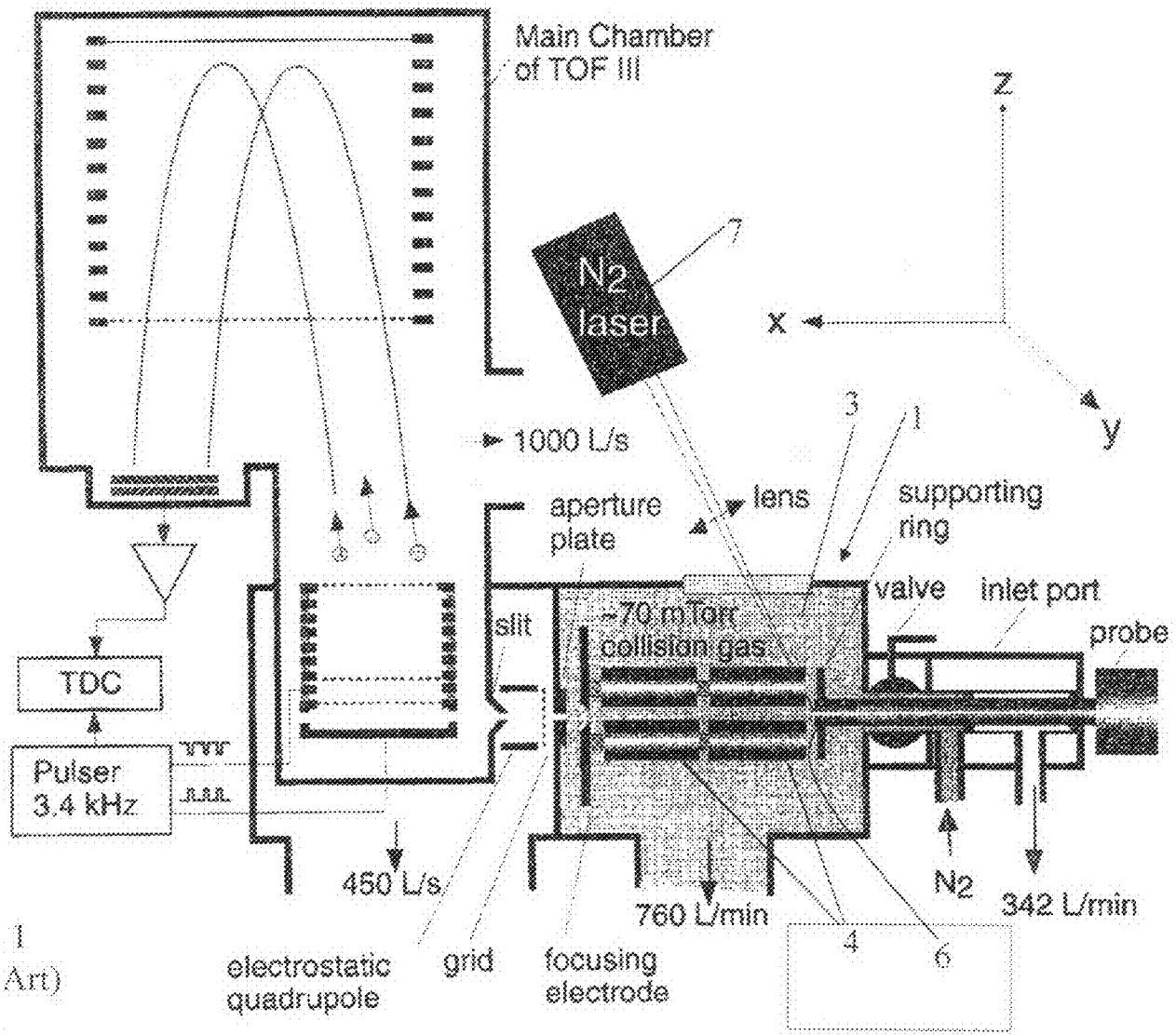
FIG. 1 (Prior Art)
FIG. 1 shows an elevated pressure MALDI source according to Standing et al.
Figure 2:
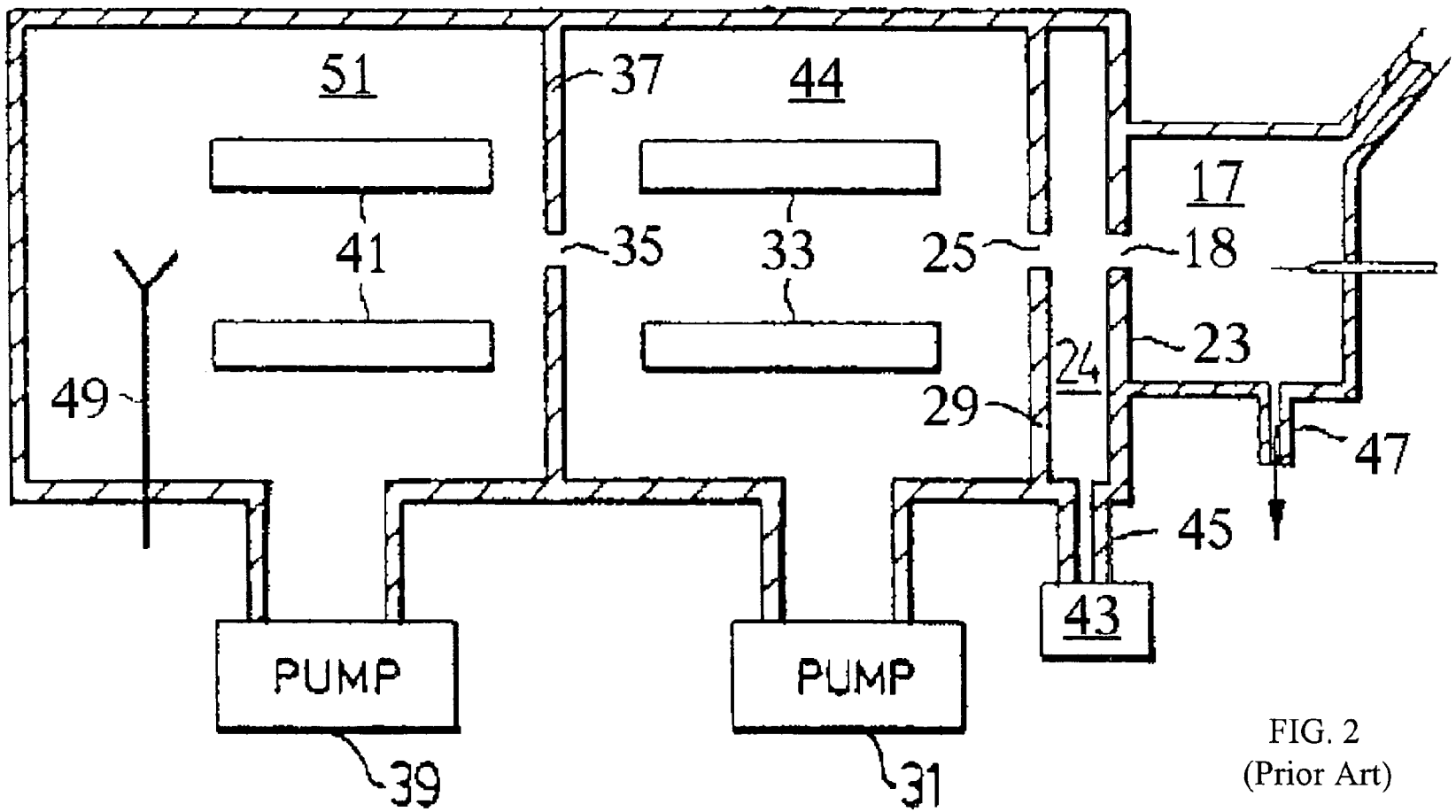
FIG. 2 (Prior Art)
FIG. 2 depicts a prior art ion guide according to Douglas et al.
Figure 3:
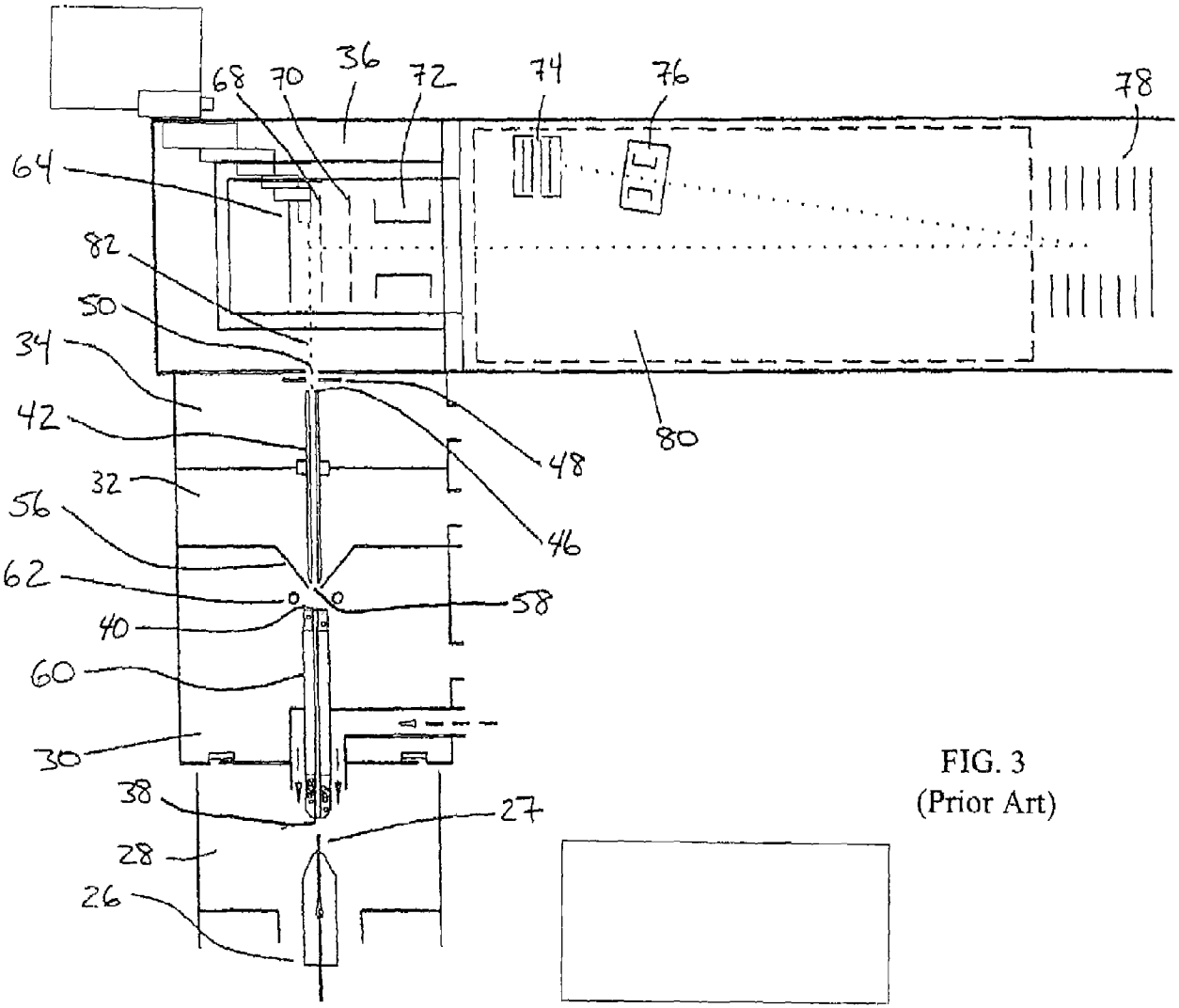
FIG. 3 (Prior Art)
FIG. 3 depicts a prior art mass spectrometer according to Whitehouse et al., including an ion guide for transmitting ions across differential pumping stages.
Figure 4:
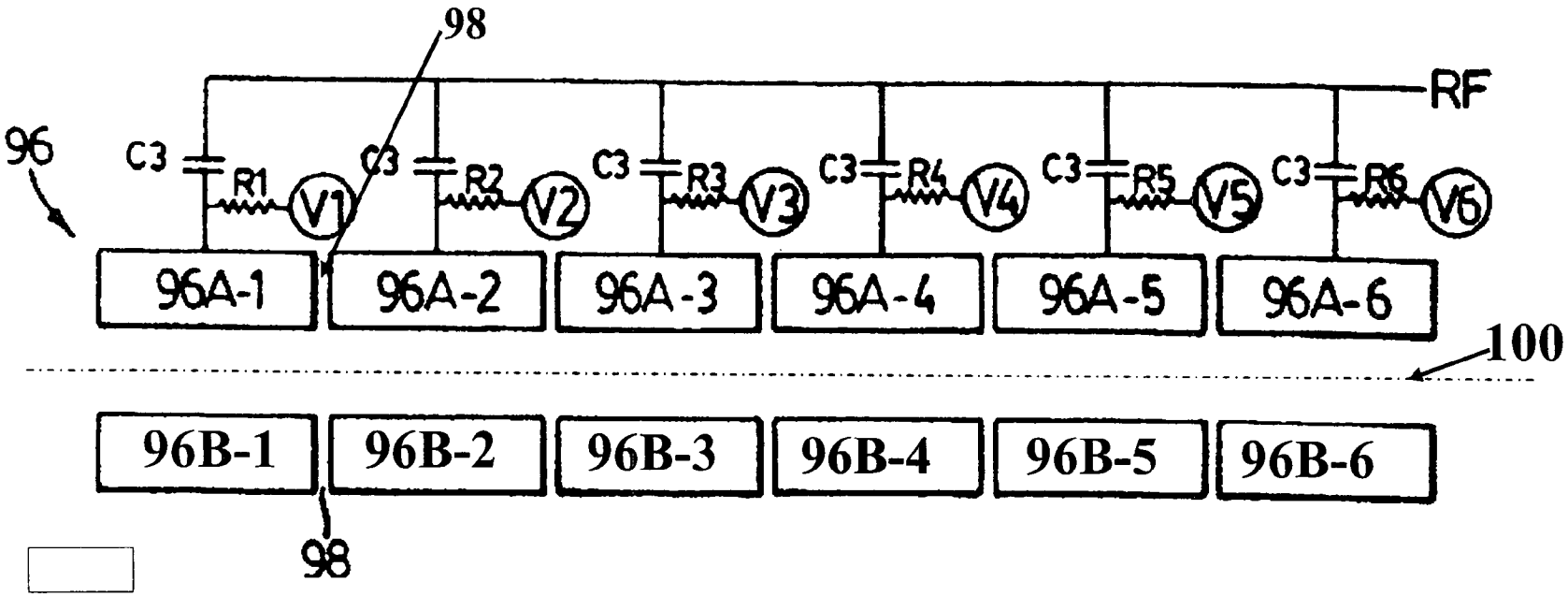
FIG. 4 (Prior Art)
FIG. 4 is a diagram of a prior art segmented multipole according to Thomson et al.
Figure 5:
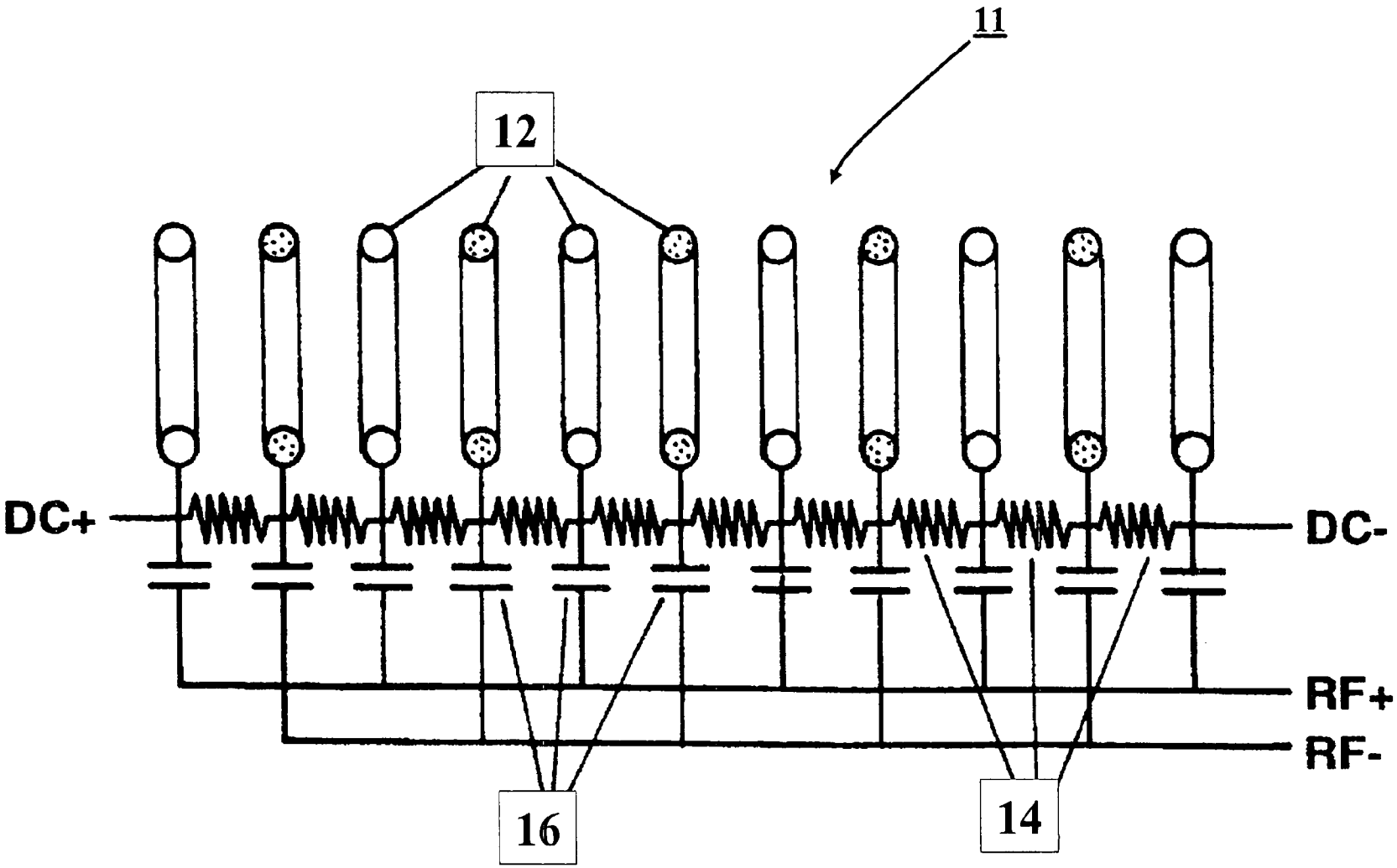
FIG. 5 (Prior Art)
FIG. 5 shows a prior art "stacked ring" ion guide according to Franzen et al.
Figure 6:
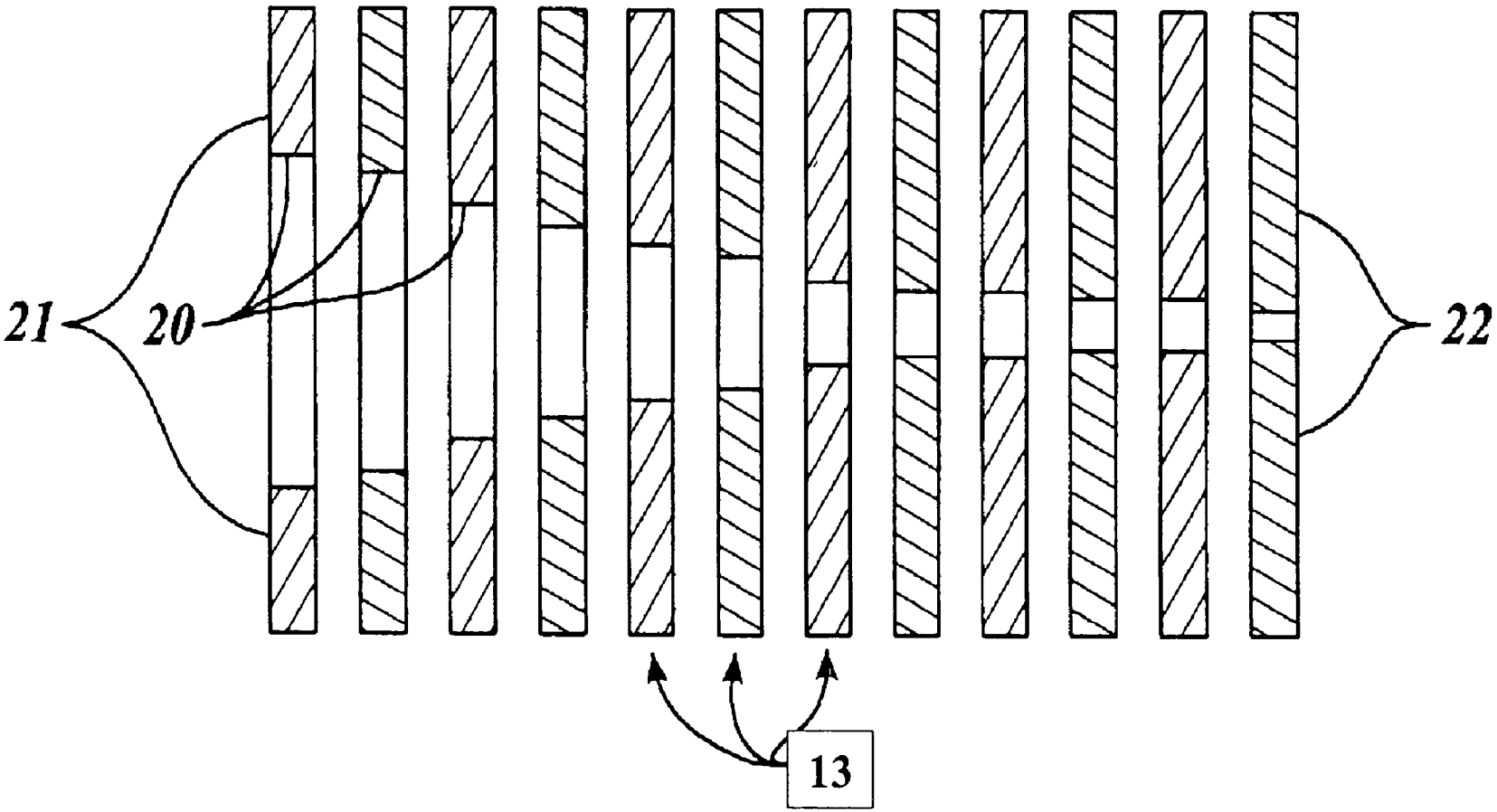
FIG. 6 (Prior Art)
FIG. 6 depicts a prior art "ion funnel" guide according to Smith et al.
Figure 7C:
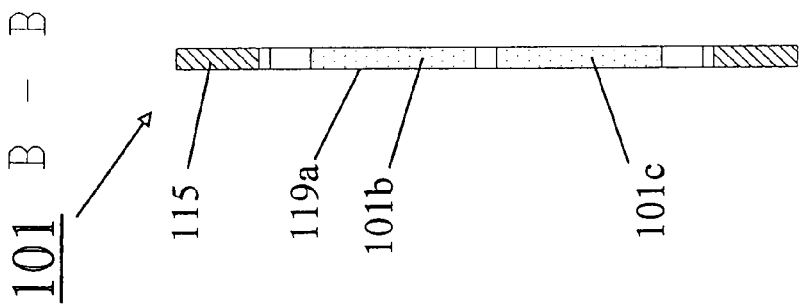
FIG. 7C is a cross-sectional view of the segmented electrode of FIG. 7A formed at line B-B.
Figure 7B:
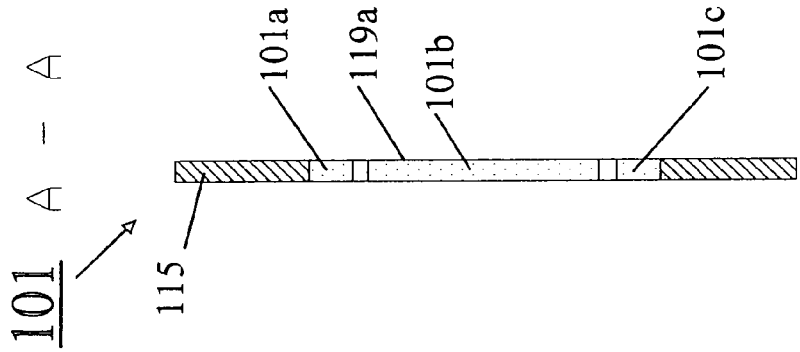
FIG. 7B is a cross-sectional view of the segmented electrode of FIG. 7A formed at line A-A.
Figure 7A:
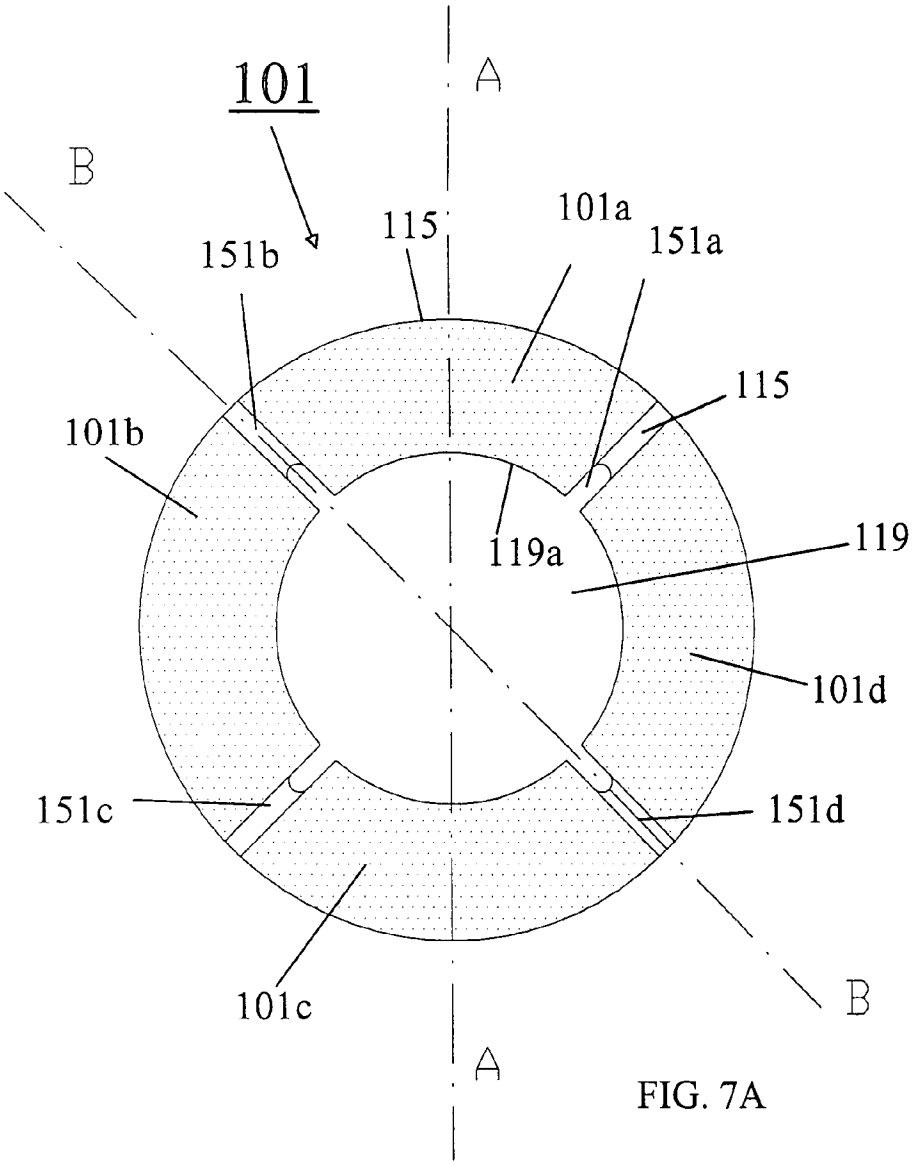
FIG. 7A depicts a "segmented" electrode ring according to the present invention which, in this example, includes four electrically conducting segments.

With reference first to FIGS. 7A-C, shown is a plain view of "segmented" electrode 101 according to the present invention. More particularly, FIG. 7B shows a cross-sectional view formed at line A-A in FIG. 7A. FIG. 7C shows a cross-sectional view formed at line B-B in FIG. 7A. In the preferred embodiment, segmented electrode 101 includes ring-shaped electrically insulating support 115 having aperture 119 through which ions may pass. Four separate electrically conducting elements 101*a*-101*d* are formed on support 115 by, for example, bonding metal foils to support 115. Importantly, elements 101*a*-101*d* cover the inner rim 119*a* of aperture 119 as well as the front and back surfaces of support 115 such that ions passing through aperture 119, will in no event encounter an electrically insulating surface. Notice also slots 151*a*-151*d* formed in support 115 between elements 101*a*-101*d*. Slots 151*a*-151*d* serve not only to separate elements 101*a*-101*d* but also removes insulating material of support 115 from the vicinity of ions passing through aperture 119. The diameter of aperture 119, the thickness of segmented electrode 101, and the width and depth of slots 151*a*-151*d* may all be varied for optimal performance. However, in this example, the diameter of aperture 119 is 26 mm, the thickness of electrode 101 is 1.6 mm, and the width and depth of slots 151 are 1.6 mm and 3.8 mm, respectively.

Further, while the segmented electrode 101 shown in FIGS. 7A-C depicts the preferred embodiment of segmented electrode 101 as comprising four conducting elements 101*a*-101*d*, alternate embodiments may be configured with any number of electrically conducting elements more than one, such as two, six, or eight elements. For example, as shown in FIGS. 7D-F, segmented electrode 101' includes ring-shaped electrically insulating support 115' having aperture 119' through which ions may pass. Here, though, six separate electrically conducting elements 101*a*'-101*f*' are formed on support 115'. Importantly, elements 101*a*'-101*f*' cover the inner rim of aperture 119' as well as the front and back surfaces of support 115' such that ions passing through aperture 119', will in no event encounter an electrically insulating surface. Here too, slots are provided in support 115' between each of elements 101*a*'-101*f*' to both separate elements 101*a*'-101*f*' from each other, and remove insulating material of support 115' from the vicinity of ions passing through aperture 119'. The diameter of aperture 119', the thickness of segmented electrode 101', and the width and depth of the slots may all be varied as discussed above.

Figure 8B:
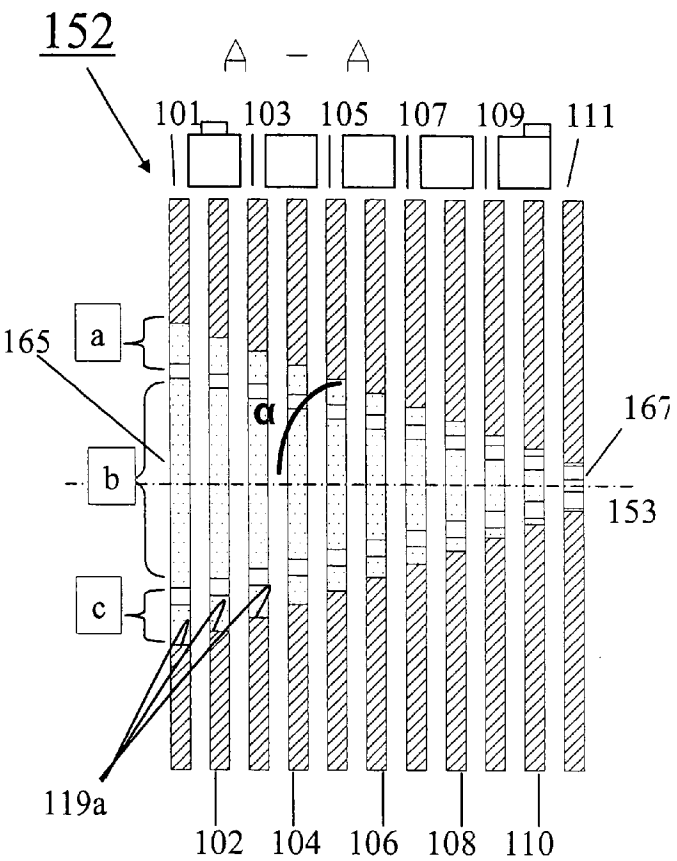
FIG. 8B is a cross-sectional view of the segmented funnel of FIG. 8A formed at line A-A.
Figure 8A:
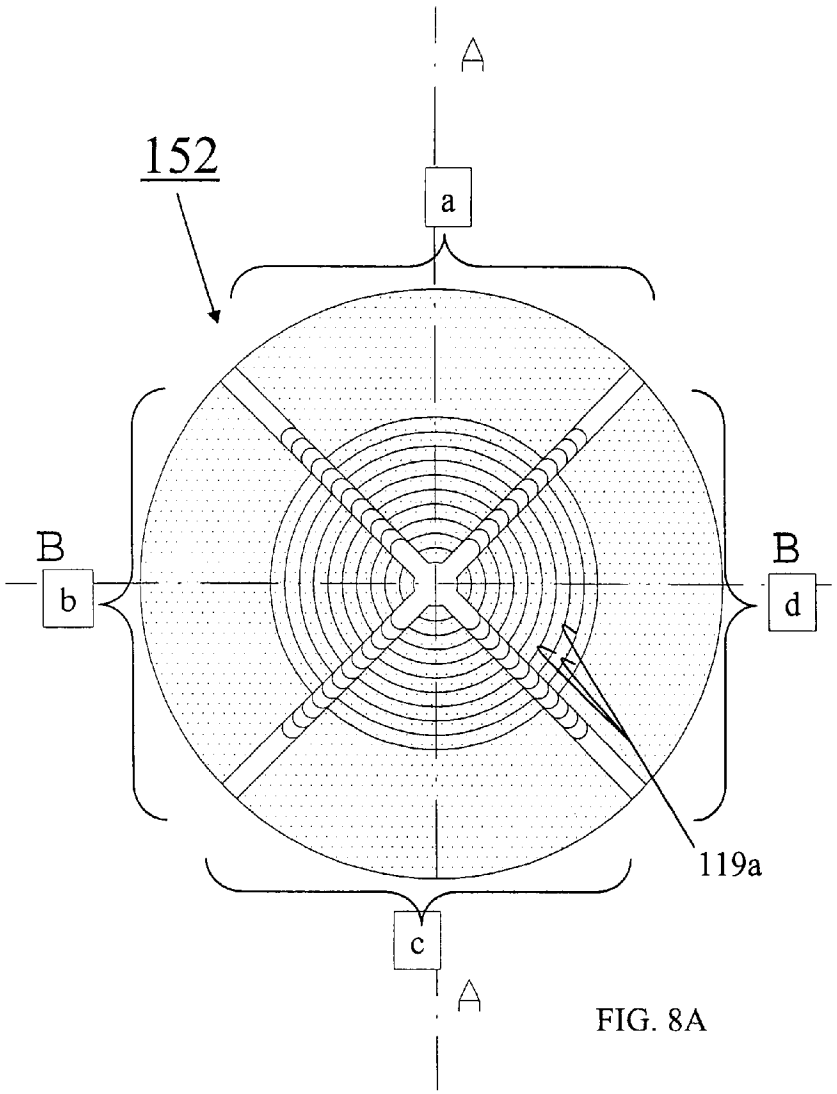
FIG. 8A depicts an end view of a "segmented" funnel according to the present invention constructed from segmented electrodes of the type shown in FIG. 7A.

Turning next to FIGS. 8A-B, shown is an end view of a set of segmented electrodes 101-111 assembled into ion guide 152 according to the preferred embodiment of the present invention. FIG. 8B shows a cross-sectional view formed at line A-A in FIG. 8A, which depicts segmented electrodes 101 through 111 assembled about a common axis 153. In the preferred embodiment of ion guide 152, the distance between adjacent electrodes 101-111 is approximately equal to the thickness of the electrodes—in this case 1.6 mm. Also, the diameter of the apertures in the electrodes 101-111 is a function of the position of the electrode in ion guide assembly 152. For example, as depicted in FIG. 8B, the segmented electrode having the largest aperture (in this example segmented electrode 101) is at the entrance end 165 of the ion guide assembly 152 and the segmented electrode having the smallest aperture (in this example segmented electrode 111) is at the exit end 167 of the ion guide assembly 152. The aperture diameter in the preferred embodiment is a linear function of the segmented electrode's position in ion guide assembly 152. However, in alternate embodiments this function may be non-linear. Further, in the preferred embodiment, the angle $\alpha$ formed between common axis 153 and the inner boundary (i.e., formed by the inner rims 119*a* of the segmented electrodes 101-111) of the ion guide assembly 152 is approximately 19°. However, alternatively, any angle between 0° and 90° may be used.

Further, each segmented electrode 101-111 in ion guide assembly 152 consists of four conducting elements a-d. Within any given segmented electrode 101-111, element a is in electrical contact with element c and element b is in electrical contact with element d. That is, element 101*a* is electrically connected to element 10*c*, element 101*b* is electrically connected to element 101*d*, element 102*a* is electrically connected to element 102*c*, and so forth.

Figure 9B:
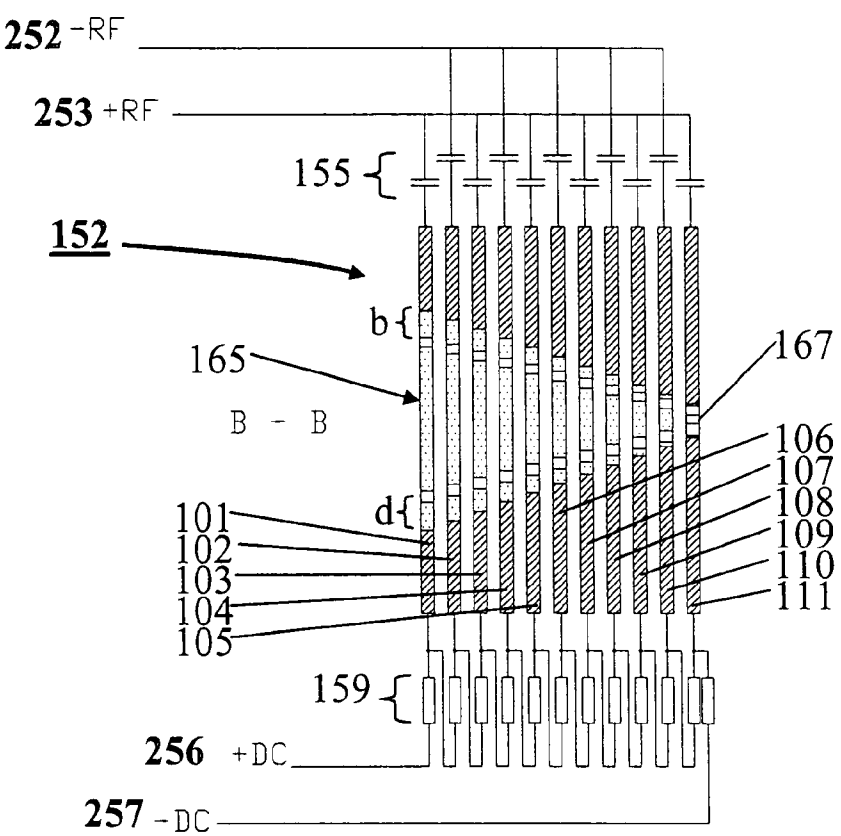
FIG. 9B shows a cross-sectional view of the segmented funnel of FIG. 8A formed at line B-B with the preferred corresponding electrical connections.
Figure 9A:
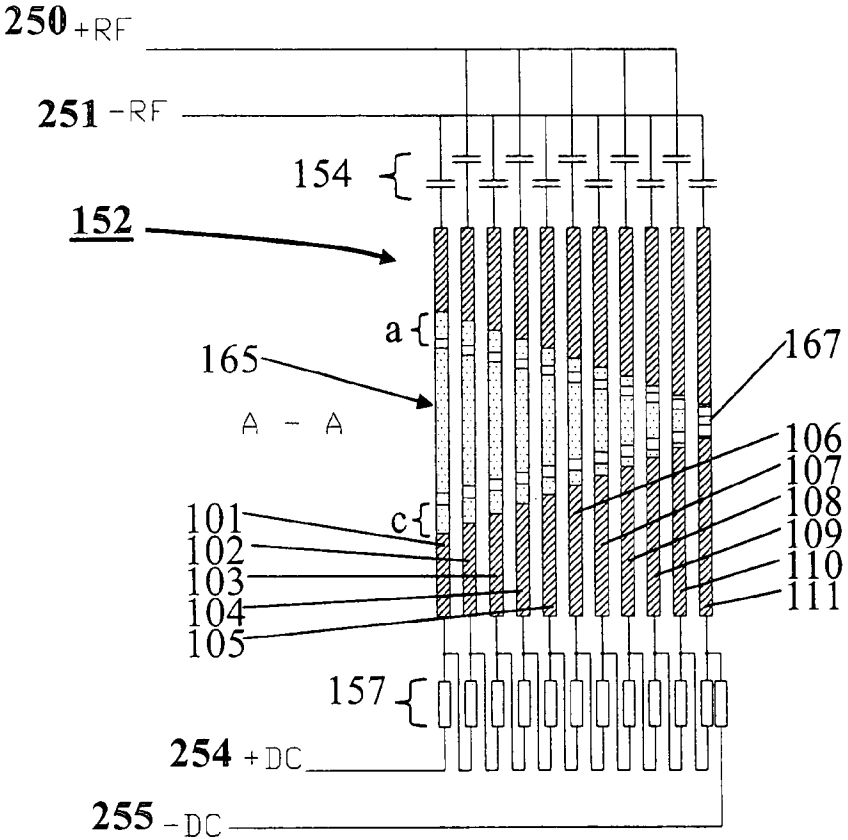
FIG. 9A shows a cross-sectional view of the segmented funnel of FIG. 8A formed at line A-A with the preferred corresponding electrical connections.

As shown in FIGS. 9A-B, the preferred embodiment of ion guide 152 comprises resistor and capacitor networks (R-C networks) to provide the electrical connection of all the elements of segmented electrodes 101-111 to power sources. FIG. 9A depicts a cross-sectional view of assembly 152 as formed at line A-A in FIG. 8A. Similarly, FIG. 9B depicts a cross-sectional view of assembly 152 as formed at line B-B in FIG. 8A. In the preferred embodiment, potentials which vary in a sinusoidal manner with time are applied to the electrodes. A first such sinusoidally varying potential is applied at +RF and a second sinusoidally varying potential of the same amplitude and frequency, but 180° out of phase, is applied at −RF.

FIG. 9A, the electrical connections for the application of the +RF 250 and −RF 251 potentials to electrodes 101*a*-111*a* and 101*c*-111*c* through capacitors 154 is shown. Similarly, electrostatic potentials +DC 254 and −DC 255 are applied to electrodes 101*a*-111*a* and 101*c*-111*c* via resistor divider 157. Similarly, FIG. 9B depicts the electrical connections for the application of the +RF 252 and −RF 253 potentials to electrodes 101*b*-111*b* and 101*d*-111*d* through capacitors 155, and the electrical connections for the application of electrostatic potentials +DC 256 and −DC 257 to electrodes 111*b*-111*b* and 111*d*-111*d* via resistor divider 159. In the preferred embodiment, capacitors 154 and 155 have the same values such that the amplitude of the RF potentials 250, 251, 252 and 253 applied to each of the electrodes 101*a*-111*a*, 101*b*-111*b*, 101*c*-111*c*, and 101*d*-111*d* of the segmented electrodes 101-111 in the ion guide assembly 152 is the same. Also, the resistor dividers 157 and 159 preferably have the same values such that the DC potential is the same on each element a-d of a given segmented electrode 101-111.

As an example, the amplitude of the RF potential applied to +RF and −RF may be 500 Vpp with a frequency of about 1 MHz. The DC potential applied between +DC and −DC may be 100 V. The capacitance of capacitors 154 and 155 may be 1 nF. And the resistance of the resistors in dividers 157 and 159 may be 10 Mohm each. Notice that for the ions being transmitted the DC potential most repulsive to the ions is applied to segmented electrode 101 (i.e., at the entrance end 165 of ion guide 152) while the most attractive DC potential is applied to segmented electrode 111 (i.e., at the exit end 167 of ion guide 152). Notice also that each electrically conducting element 101*a*-111*a*, 101*b*-111*b*, 101*c*-111*c*, and 101*d*-111*d* of the segmented electrodes 101-111 has an RF potential applied to it which is 180° out of phase with the RF potential applied to its immediately adjacent elements. For example, the RF potential applied to element 102*a* is 180° out of phase with elements 101*a* and 103*a* on the adjacent segmented electrodes 101 and 103. Similarly, the same RF potential applied to element 102*a* is 180° out of phase with elements 102*b* and 102*d* as adjacent electrically conducting elements on the same segmented electrode 102. Application of the RF potentials in this way prevents the creation of pseudopotential wells which thereby prevents or at least minimizes the trapping of ions. Pseudopotential wells, as discussed in the prior art designs of Smith et al. and of Franzen et al., can result in the loss of ion transmission efficiency or the m/z range within which ions are transmitted.

Figure 10B:
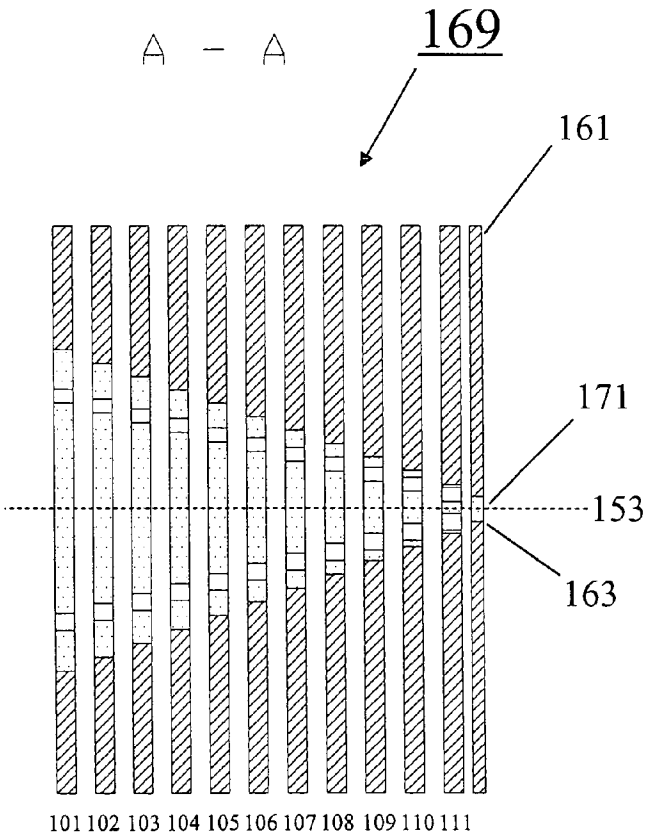
FIG. 10B shows a cross-sectional view of the segmented funnel of FIG. 10A formed at line A-A.
Figure 10A:
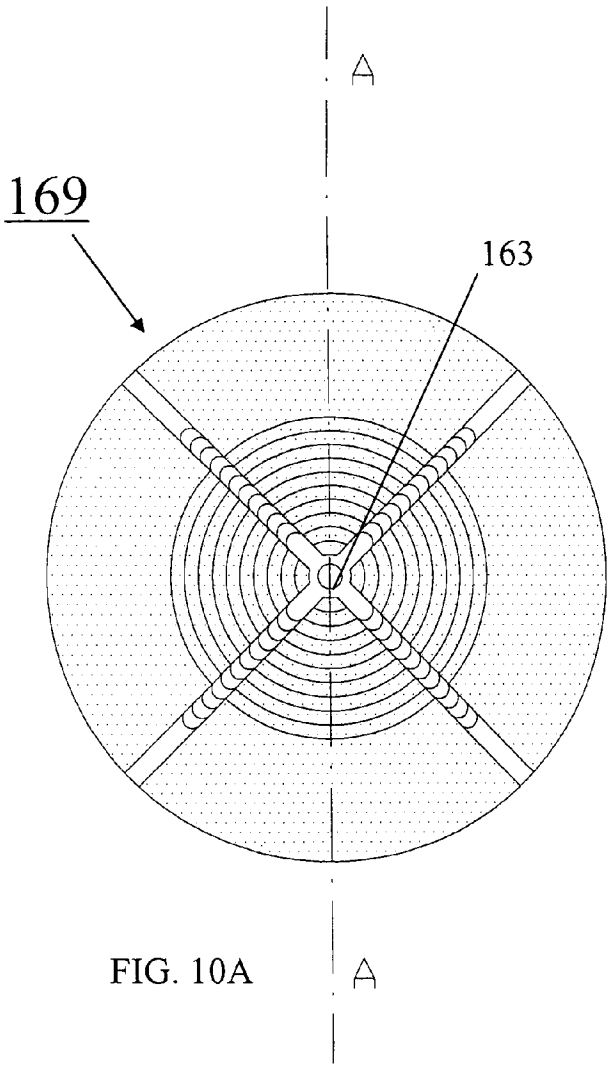
FIG. 10A shows an end view of a segmented funnel according to the present invention, including a DC lens element at its outlet end.
Figure 11:
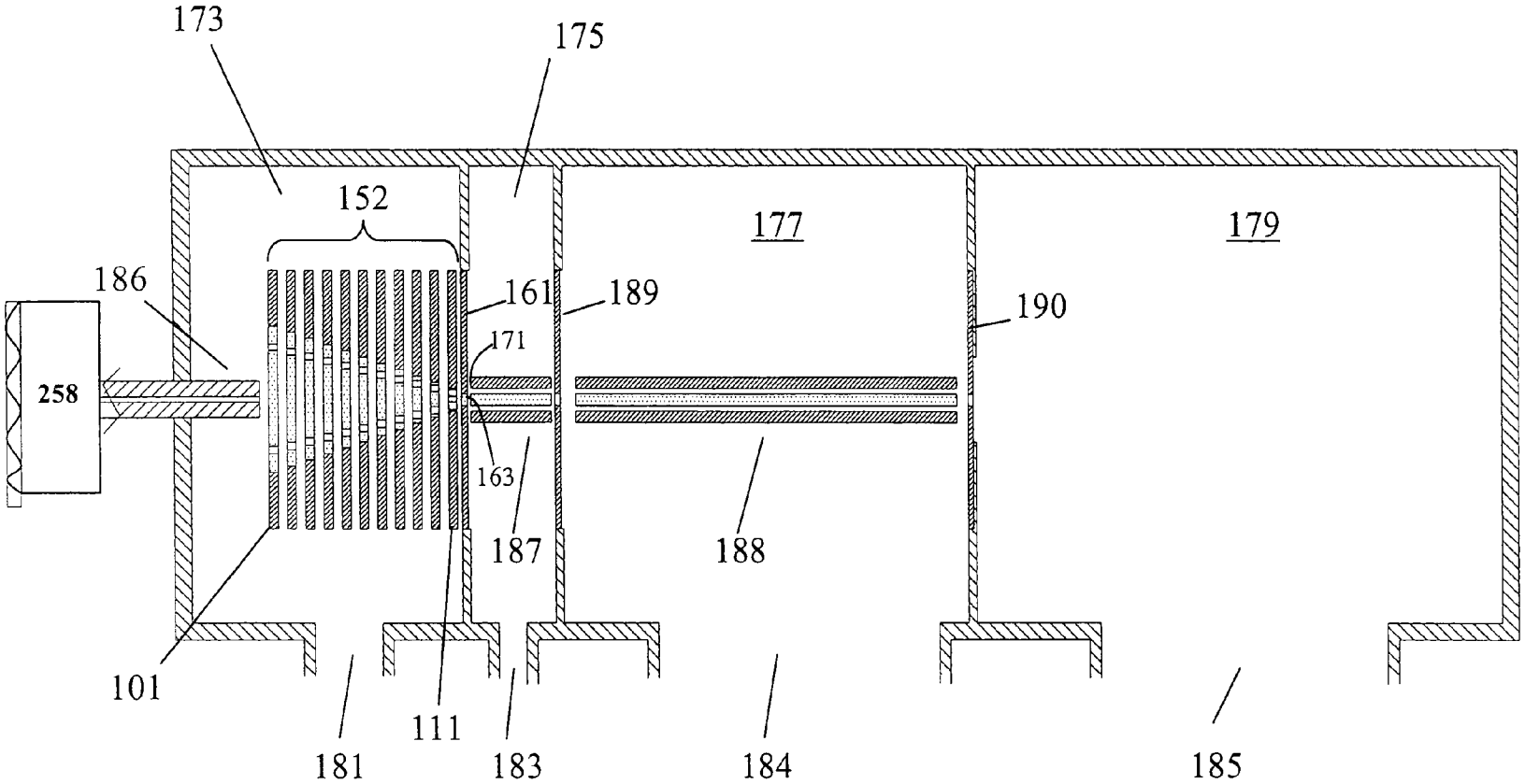
FIG. 11 depicts the segmented ion funnel of FIG. 10 in a vacuum system of a mass spectrometer, including "downstream" multipole ion guides.

Turning next to FIGS. 10A-B depicted is two separate views of ion guide assembly 152, according to an alternate embodiment of the invention, in which DC lens element 161 is provided at outlet end 171 of ion guide assembly 152. FIG. 10B shows a cross-sectional view formed at line A-A in FIG. 10A. In the preferred embodiment, lens element 161 is composed of electrically conducting material. Alternatively, lens element 161 may comprise an insulator having an electrically conductive coating. Preferably, lens element 161 includes aperture 163 aligned with axis 153 of ion guide 152. It is also preferred that aperture 163 be round with a diameter of approximately 2 mm. However, in alternate embodiments, the aperture may take any desired shape or size. In practice the DC potential applied to lens element 161 should be more attractive to the transmitted ions than segmented electrode 111. As an ion guide, the present invention has applicability in a variety of ways in a mass spectrometer system. FIG. 11 depicts the ion guide assembly 161 of FIG. 10 in the vacuum system of a mass spectrometer. The vacuum system of the mass spectrometer shown consists, for example, of four chambers 173, 175, 177 and 179. Although gas pressures in the chambers may vary widely, examples of gas pressures in a system such as this are ~1 mbar in chamber 173, ~$5\times10^{-2}$ mbar in chamber 175, ~$5\times10^{-3}$ mbar in chamber 177, and ~$5\times10^{-7}$ in chamber 179. To achieve and maintain the desired pressure levels in these chambers, each of chambers 173, 175, 177, and 179 include pumping ports 181, 183, 184, and 185, respectively, through which gas may be pumped away.

In the embodiment shown, capillary 186 transmits ions and gas from an atmospheric pressure ion production means 258 into chamber 173. As indicated previously, such ion production means may include any known API means including but not limited to ESI, atmospheric pressure chemical ionization, atmospheric pressure MALDI, and atmospheric pressure photoionization. Also, other known prior art devices might be used instead of capillary 186 to transmit ions from ion production means 258 into first chamber 173. Once the transmitted ions exit capillary 186 into first chamber 173, ion guide assembly 152, residing in first chamber 173, accepts the transmitted ions, while gas introduced via capillary 186 is pumped away via pumping port 181 to maintain the desired pressure therein. Through the appropriate application of electric potentials as discussed above with respect to FIGS. 9A-B and 10A-B, ion guide assembly 152 focuses the transmitted ions from the exit end of the capillary 186 toward and through aperture 163 of lens element 161 positioned at outlet end 171 of ion guide 152. In addition, lens element 161 preferably acts as a pumping restriction between first chamber 173 and second chamber 175.

Preferably, multipole ion guide 187 resides in second chamber 175 and multipole ion guide 188 resides in third chamber 177. Ion guide 187 serves to guide ions through chamber 175 toward and through lens 189, while ion guide 188 similarly serves to guide ions from lens 189 through chamber 177 toward and through lens 190. Lenses 189 and 190 may also serve as pumping restrictions between chambers 175 and 177 and between chambers 177 and 179, respectively. In addition, lenses 189 and 190 are shown as electrode plates having an aperture therethrough, but other known lenses such as skimmers, etc., may be used. Ions passing through lens 190 into fourth chamber 179 may subsequently be analyzed by any known type of mass analyzer (not shown) residing in chamber 179.

Although the potentials applied to the components of the system shown in FIG. 11 may be varied widely, an example of the DC electric potentials which may be applied to each component in operating such a system are:

| | |
|---|---|
| capillary 186 | 125 V |
| segmented electrode 1 | 120 V |
| segmented electrode 111 | 20 V |
| lens element 161 | 19 V |
| multipole 187 | 18 V |
| lens element 189 | 17 V |
| multipole 188 | 15 V |
| lens element 190 | 0 V. |

In an alternate embodiment, lens element 161 might be replaced with a segmented electrode of essentially the same structure as segmented electrodes 101-111. In such an embodiment, lens element 161 would preferably be electrically driven in substantially the same manner as the electrodes 101-111—i.e. RF and DC potentials—but would additionally act as a pumping restriction.

In the preferred embodiment of FIG. 11, the multipoles 187 and 188 are hexapoles, however in alternate embodiments they might be any type of multipole ion guide—e.g quadrupole, octapole, etc. The RF potential applied to the rods of multipoles 187 and 188 may also vary widely, however one might apply a sinusoidally varying potential having an amplitude of 600 Vpp and frequency of 5 MHz.

In an alternate embodiment, multipole 188 might be a quadrupole. Further, as is known in the prior art, one might use multipole 188 to select and fragment ions of interest before transmitting them to chamber 179.

Figure 12:
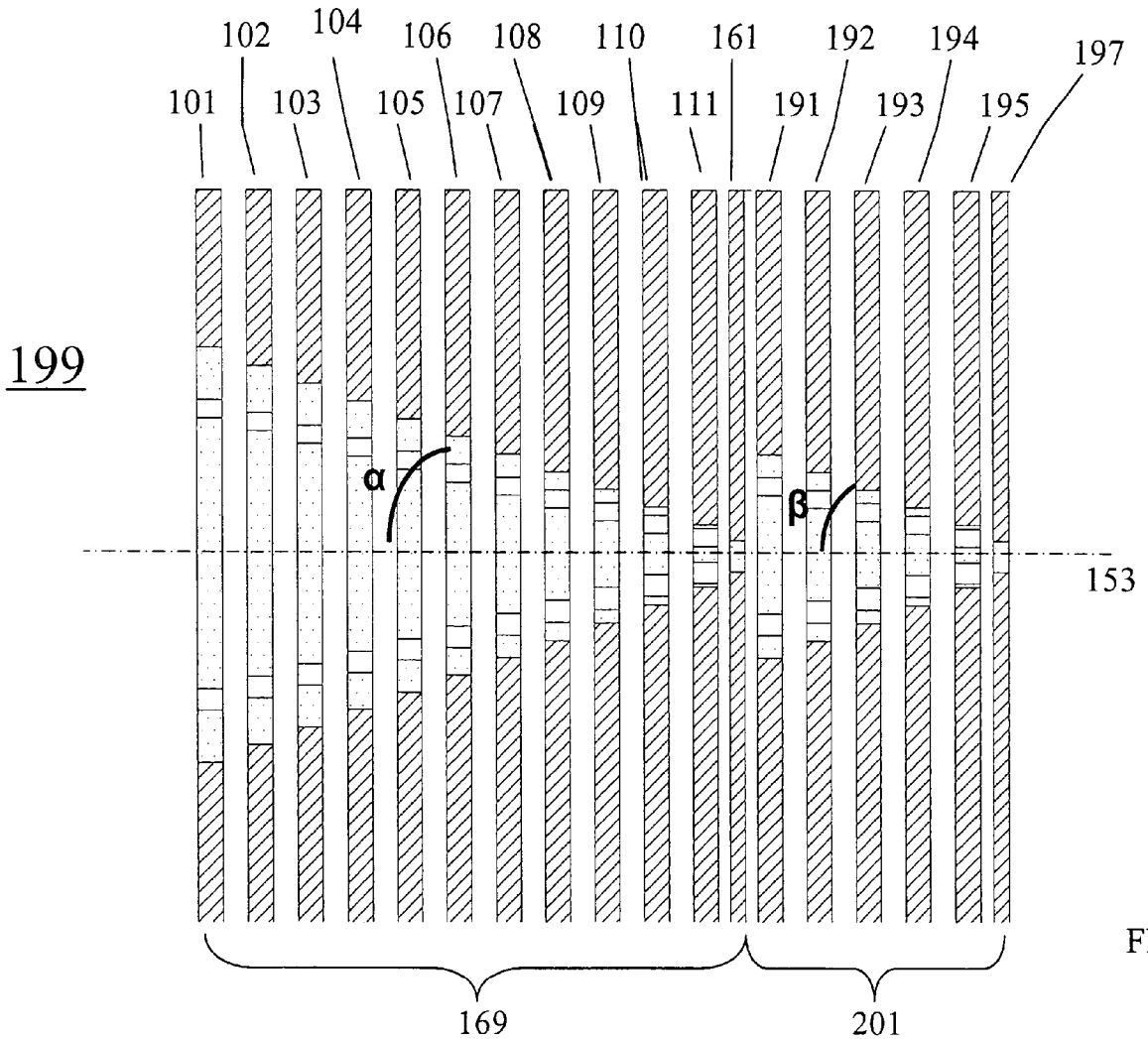
FIG. 12 is a cross-sectional view of a two-stage segmented ion funnel.

Turning next to FIG. 12, a two-stage ion guide 199 according to yet another alternate embodiment of the invention is depicted. As shown, two-stage ion guide 199 incorporates ion guide assembly 152 of FIGS. 10A-B with a second ion guide 201 comprising additional segmented electrodes 191-195 and DC lens 197. In this embodiment, ion guide assembly 152 acts as the first stage of two-stage ion guide 199, with the additional segmented electrodes 191-195 and lens 197 forming second stage 201 of the two-stage ion guide 199. As depicted, all of the segmented electrodes 101-111 and 191-195 and lenses 161 and 197 are aligned on common axis 153. While the angle β formed between the common axis 153 and the inner boundary (i.e., formed by the inner, rims of the segmented electrodes 191-195) of the second stage 201 of two-stage ion guide 199 is independent from angle α of first stage ion guide assembly 169 (the angle α is discussed above in regard to FIGS. 8A-B), these angles α and β are preferably the same. Similarly, the thickness and spacing between segmented electrodes 191-195 are preferably the same as the thickness of and spacing between segmented electrodes 101-111, as discussed above. Also, it is preferred that lens 197 is electrically conducting with a 2 millimeter (mm) diameter aperture aligned on axis 153. The RF potentials applied to the electrically conducting elements of segmented electrodes 191-195 are preferably of the same amplitude and frequency as that applied in first stage ion guide assembly 152. The DC potentials applied to segmented electrodes 191-195 are such that ions are repelled from lens 161 and attracted toward lens 197.

Figure 13:
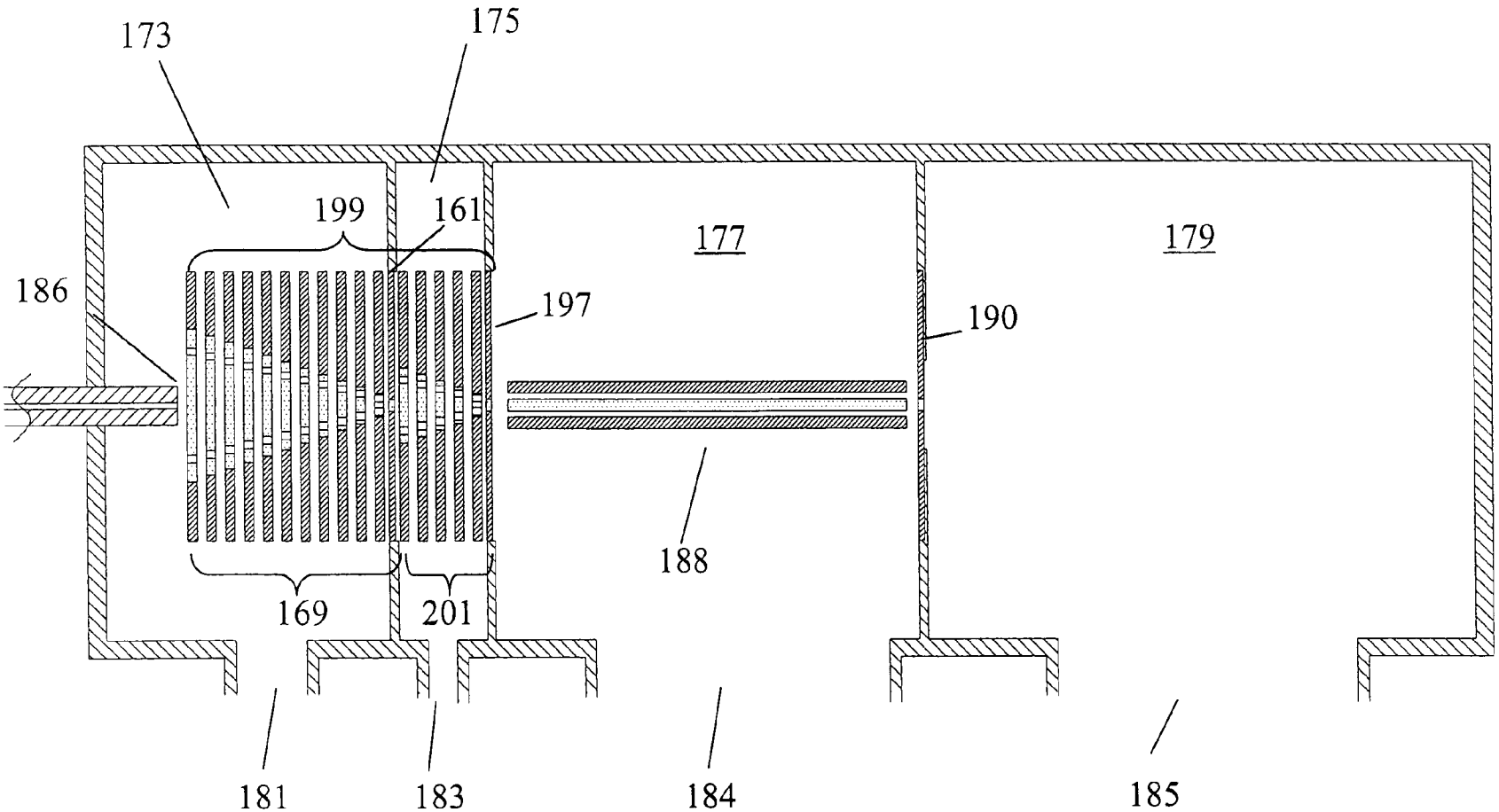
FIG. 13 depicts the two-stage segmented ion funnel of FIG. 12 in a vacuum system of a mass spectrometer, including a "downstream" multipole ion guide.

Like FIG. 11, FIG. 13 depicts an ion guide according to the invention as it may be used in a mass spectrometer. Specifically, FIG. 13 depicts the two-stage ion guide 199 of FIG. 12 positioned in the vacuum system of a mass spectrometer. The system depicted in FIG. 13 is the same as that of FIG. 11 with the exception that ion guide 187 and lens 189 shown in FIG. 11 are replaced with second stage ion guide 201 in FIG. 13 which includes ion lens 197. As depicted in FIG. 13, two stage ion guide 199 is capable of accepting and focusing ions even at a relatively high pressure (i.e., ~1 mbar in first pumping chamber 173) and can efficiently transmit them through a second, relatively low pressure differential pumping stage (i.e., $\sim 5\times10^{-2}$ mbar in second pumping chamber 175) and into a third pumping chamber 177. Notice that although lenses 161 and 197 are shown to be integrated into two-stage ion guide 199, they also act as pumping restrictions between chambers 173 and 175, and between 175 and 177, respectively. The ability of two-stage ion guide 199, as a single device, to efficiently guide and transmit ions over a wide range of pressure regions and through a plurality of pumping stages is one of the principle advantages of the present invention over prior art ion guides.

In an alternate embodiment, lens element 161 might be replaced with a segmented electrode of essentially the same structure as segmented electrodes 101-111. In such an embodiment, lens element 161 would preferably be electrically driven in substantially the same manner as the electrodes 101-111—i.e. RF and DC potentials, but would additionally act as a pumping restriction.

In a further alternate embodiment, lens element 197 might also be replaced with a segmented electrode of essentially the same structure as segmented electrodes 101-111 and 191-195. In such an embodiment, lens element 197 would preferably be electrically driven in substantially the same manner as the electrodes 101-111 and 191-195—i.e. RF and DC potentials—but would additionally act as a pumping restriction.

Figure 14:
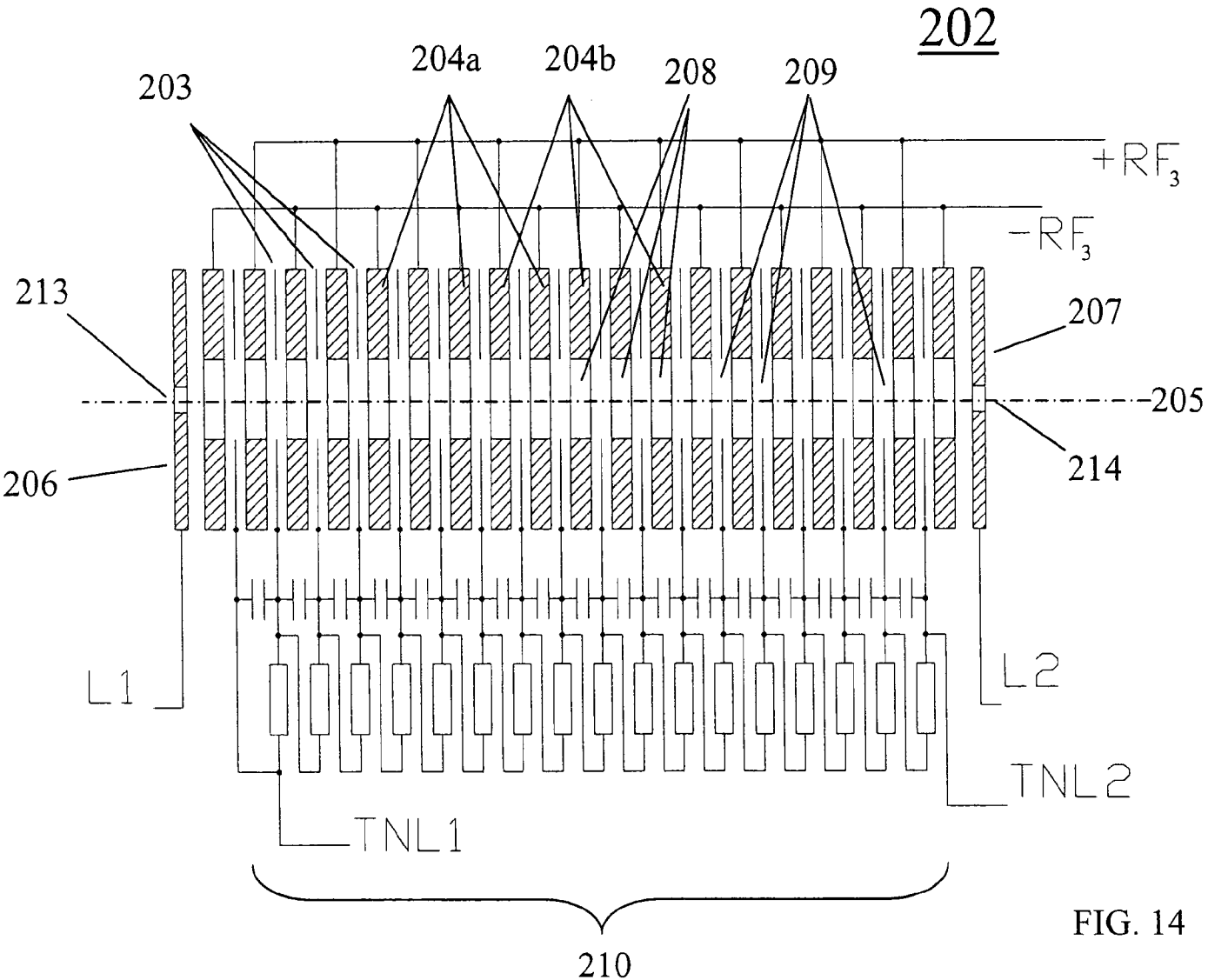
FIG. 14 shows a cross-sectional view of a "stacked ring" ion guide according to an alternative embodiment of the present invention, including "DC electrodes" interleaved with RF guide rings.

Referring now to FIG. 14, depicted is a "stacked ring" ion guide 202 according to yet another alternate embodiment of the present invention. As shown, stacked ring ion guide 202 includes "DC electrodes" 203 interleaved with RF guide rings 204*a* and 204*b*. Preferably, RF guide rings 204 are apertured plates preferably composed of electrically conducting material (e.g., metal). The dimensions and placement of RF guide rings 204 may vary widely. However, it is preferred that RF guide rings 204*a* and 204*b* be approximately 1.6 mm thick, have apertures 208 which are approximately 6 mm in diameter, and be positioned with spacing between adjacent RF guide rings 204*a* and 204*b* of 1.6 mm. Also, rings 204*a* and 204*b* are preferably aligned along common axis 205. As shown, this embodiment includes apertured lens elements 206 and 207 positioned at either end of stacked ring ion guide 202 and are also aligned along axis 205. Lenses 206 and 207 are preferably electrically conducting plates with approximately 2 mm diameter apertures.

Stacked ring ion guide 202 also comprises DC electrodes 203 which are thin (e.g., ~0.1 mm) electrically conducting plates positioned midway between adjacent RF guide rings 204*a* and 204*b* and have apertures 209 with preferably the same diameter as apertures 208 in RF guide rings 204*a* and 204*b*.

During operation, sinusoidally time-varying potentials $RF_3$ are applied to RF guide rings 204. Preferably a first time-varying potential $+RF_3$ is applied to ring 204*a*, and a second time-varying potential $-RF_3$ is applied to rings RF guide 204*b*. Potentials $+RF_3$ and $-RF_3$ are preferably of the same amplitude and frequency but are 180° out of phase with one another. Also, the potentials $+RF_3$ and $-RF_3$ may have a non-zero reference potential such that the entire stacked ring ion guide 202 has a "DC offset" of, for example, ~15V. Potentials are applied to DC electrodes 203 via RC network 210. In the preferred method of operation, the inputs TNL1 and TNL2 to RC network 210 are maintained at the same electrostatic potential as the DC offset of stacked ring ion guide 202 as a whole. Alternatively, to trap ions in the ion guide, one can set the DC potentials on lenses 206 and 207 to some potential above the DC offset of the remainder of stacked ring ion guide 202.

Figure 15:
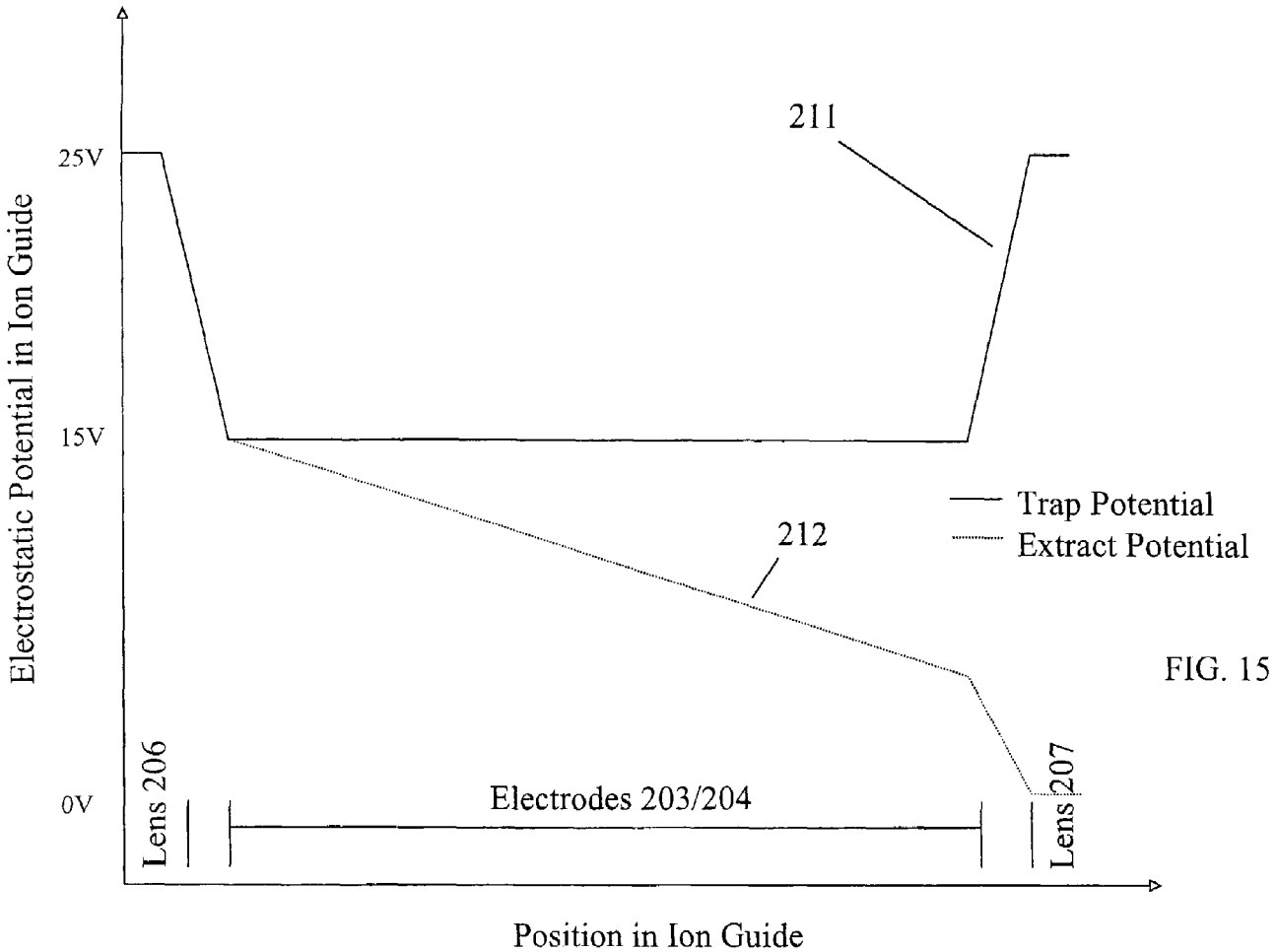
FIG. 15 is a plot of electric potential vs. position within the "stacked ring" ion guide shown in FIG. 14.

FIG. 15 shows a plot of electric potential vs. position within stacked ring ion guide 202. In particular, trace 211 of FIG. 15 is a plot of the electrostatic potential on axis 205 of ion guide 202 when operated in the manner described above to trap ions. One may operate stacked ring ion guide 202 in this manner to accumulate ions within stacked ring ion guide 202. Ions may be introduced into stacked ring ion guide 202 from an ion production means via aperture 213 in lens 206 (see FIG. 14). Ions may then undergo collisions with a gas in stacked ring ion guide 202 thus losing kinetic energy and becoming trapped. The efficiency of trapping ions in this manner is dependent on the gas pressure and composition within stacked ring ion guide 202.

Once ions are trapped in stacked ring ion guide 202, the electrostatic potential along axis 205 may be changed so as to eject ions from stacked ring ion guide 202. Trace 212 of FIG. 15 shows the electrostatic potential as a function of position along axis 205 when the potential at TNL2 (see FIG. 14) is lowered to only a few volts and potential L2 (see FIG. 14) applied to lens 207 is lowered to 0V. The gradient in the electrostatic potential along axis 205 will tend to eject ions from guide 202 through aperture 214 in lens 207.

When operated in the preferred manner, the potential on the elements 203 of stacked ring ion guide 202 are maintained for a predetermined time so as to accumulate and trap ions from an ion production means in stacked ring ion guide 202. After this predetermined time, however, the potentials TNL2 and L2 are rapidly pulsed to lower potentials so as to quickly eject ions from stacked ring ion guide 202. In the preferred method, the transition of the potentials TNL2 and L2 is on the same order of or faster than the frequency of the RF potential applied at $RF_3$. Notice that, unlike the prior art ion guide of Franzen et aL discussed above, the formation of an electrostatic field along the axis of stacked ring ion guide 202 does not require the application of a DC potential gradient to RF guide rings 204*a* and 204*b*. Rather, the electrostatic field is formed via DC electrodes 203 independent of RF guide rings 204*a* and 204*b*. As a result, the electrostatic gradient represented by trace 212 can be generated as rapidly as necessary without considering the frequency at which RF guide rings 204*a* and 204*b* are being driven. As an example, potentials $+RF_3$ and $-RF_3$ may be 500 Vpp at 1 MHz, ions may be accumulated for 10 msec from an ESI source. Thereafter, the potentials TNL2 and L2 can be lowered to 4 V and 0 V respectively in a pulsed manner with a fall time of 100 ns and a duration of 100 μsec. After the duration of 100 μsec, the potentials TNL2 and L2 can be raised to their trapping potentials of 15 V and 25 V, respectively, and the process may be repeated. The pulses of ions thus produced are injected into a mass analyzer residing "downstream" from stacked ring ion guide 202.

Figure 16:
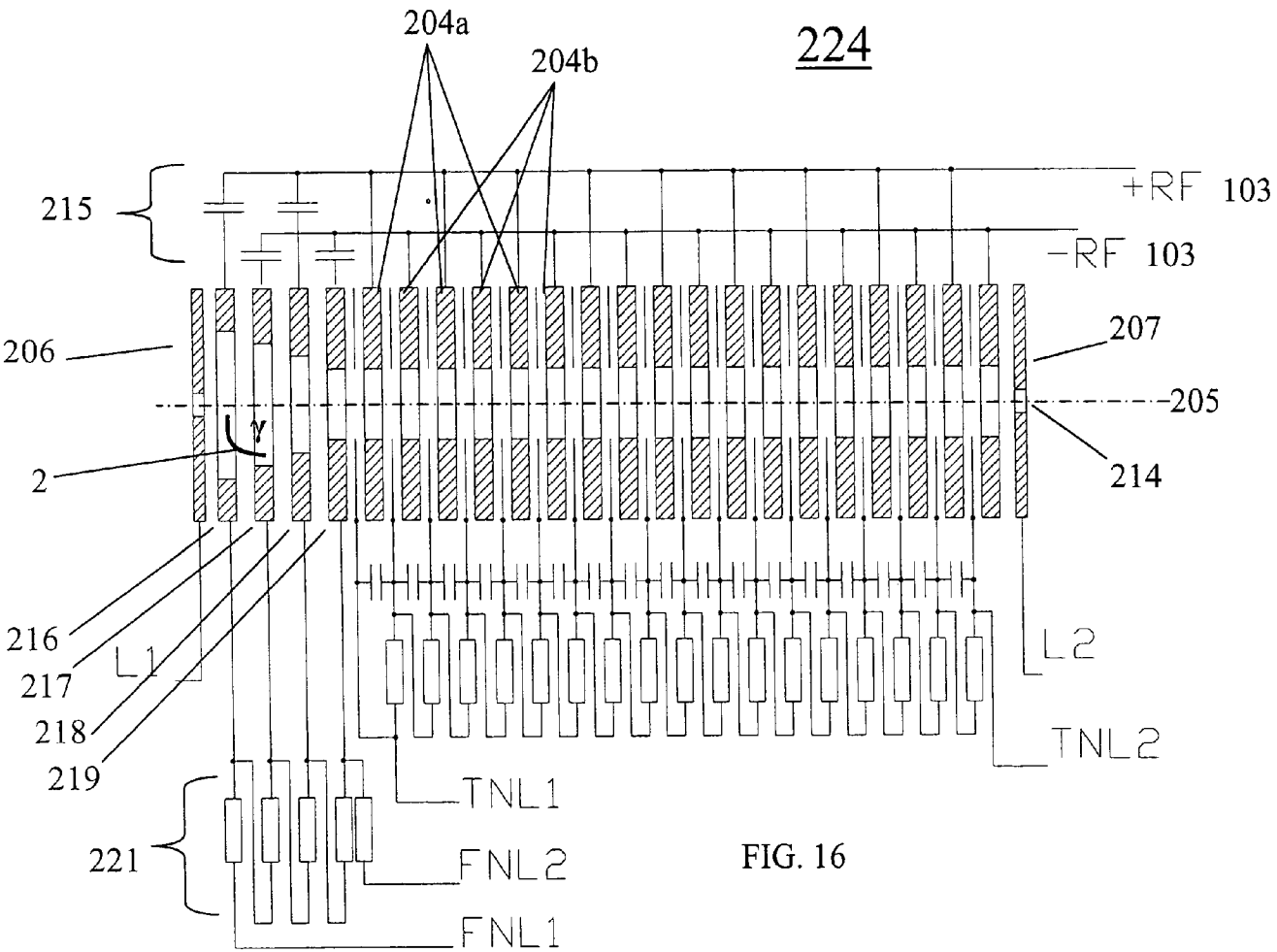
FIG. 16 depicts a cross-sectional view of an alternative embodiment of the ion guide according to the present invention comprising features of both the funnel and the stacked ring ion guides shown in FIGS. 8A-B and 14, respectively.

Turning next to FIG. 16, shown is yet another alternative embodiment of an ion guide according to the present invention. As shown, this embodiment comprises features of both ion funnel 152 (FIGS. 8A-B) and stacked ring ion guide 202 (FIG. 14). Specifically, ion guide 220 of FIG. 16 is the same as ion guide 202 with the addition of guide rings 216-219, capacitors 215, and resistor divider 221. In this embodiment, guide rings 216-219 act as a funnel-like ion guide as describe above. The thickness and spacing between guide rings 216-219 may vary widely. However, the thickness of electrodes 216-219 is preferably the same as that of rings 204*a* and 204*b* (e.g., 1.6 mm) and the spacing between electrodes 216-219 is preferably the same as that between electrodes 204*a* and 204*b* (e.g. 1.6 mm). Also, the angle γ formed between common axis 205 of ion guide 220 and the inner boundary ring electrodes 216-219 may vary widely. However, it is shown here to be 19°. The RF potential on guide rings 216-219 is set by $RF_3$ and $-RF_3$ through capacitors 215 as described above. In the preferred method of operation, the RF potential applied to guide rings 216-219 is the same as that applied to RF rings 204*a* and 204*b*. However, in alternate embodiments, the RF potential applied to rings 216-219 might be of a different amplitude or frequency than that applied to rings 204*a* and 204*b*. The DC potentials on rings 216-219 are applied via resistor divider 221. Also in the preferred method of operation, the potentials FNL1 and FNL2 applied to resistor divider 221 are such that ions are accelerated along axis 205 toward the exit end of the ion guide 220 at lens 207. Also, in the preferred method of operation, the DC potential on ring 219 should be approximately the same or slightly higher than that on electrodes 204*a* and 204*b*, as represented in traces 222 and 223 in FIG. 17.

Figure 17:
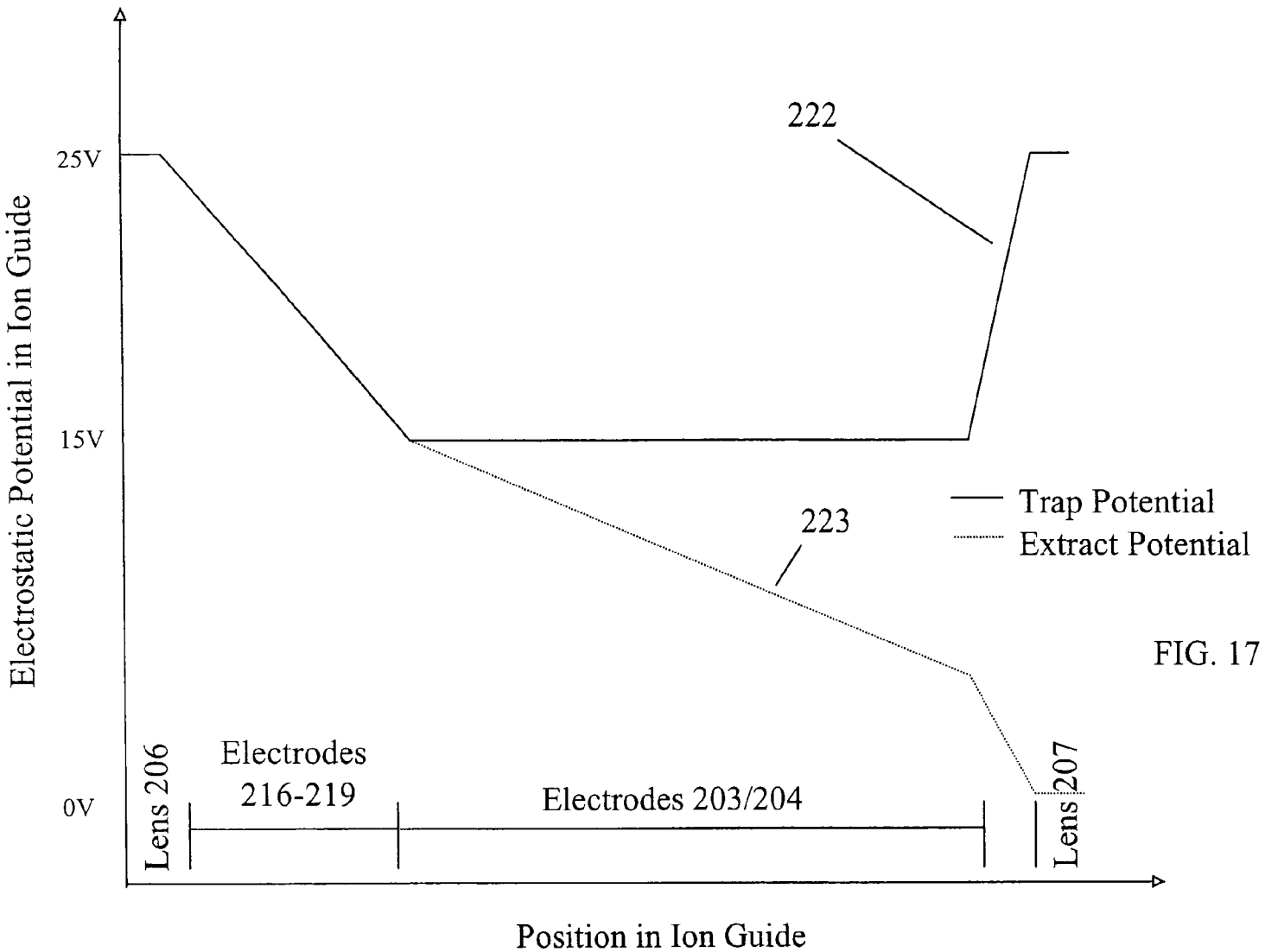
FIG. 17 is a plot of electric potential vs. position within the "funnel/stacked ring" ion guide shown in FIG. 16.

Similar to FIG. 15, FIG. 17 plots the electrostatic potential as a function of position in ion guide 220 on axis 205. First, trace 222 of FIG. 17 is a plot of the electrostatic potential on axis 205 of ion guide 220 when operated to trap ions. One may operate in this manner to accumulate ions in ion guide 220. Ions may be introduced into guide 220 from an ion production means via aperture 213 in lens 206 (see FIG. 16). Ions may then undergo collisions with a gas in guide 220 thus losing kinetic energy and becoming trapped. The efficiency of trapping ions in this manner is dependent on the gas pressure and composition in ion guide 220.

Once ions are trapped in ion guide 220, the electrostatic potential along axis 205 may be changed so as to eject ions from ion guide 220. Trace 223 of FIG. 17 shows the electrostatic potential as a function of position along axis 205 when the potential at TNL2 (see FIG. 16) is lowered to only a few volts and potential L2 (see FIG. 16) applied to lens 207 is lowered to 0V. The gradient in the electrostatic potential along axis 205 will tend to eject ions from guide 220 through aperture 214 in lens 207.

When operated in the preferred manner, the potential on the elements 203 of ion guide 220 are maintained for a predetermined time so as to accumulate and trap ions from an ion production means in ion guide 220. After this predetermined time, however, the potentials TNL2 and L2 are rapidly pulsed to lower potentials so as to quickly eject ions from ion guide 220. In the preferred method, the transition of the potentials TNL2 and L2 is on the same order of or faster than the frequency of the RF potential applied at $RF_3$. Notice that, unlike the prior art ion guide of Franzen et al. discussed above, the formation of an electrostatic field along the axis of ion guide 220 does not require the application of a DC potential gradient to RF guide rings 204*a* and 204*b*. Rather, the electrostatic field is formed via DC electrodes 203 independent of RF guide rings 204*a* and 204*b*. As a result, the electrostatic gradient represented by trace 223 can be generated as rapidly as necessary without considering the frequency at which RF guide rings 204*a* and 204*b* are being driven. As an example, potentials $+RF_3$ and $-RF_3$ may be 500 Vpp at 1 MHz, and ions may be accumulated for 10 msec from an ESI source. Thereafter, the potentials TNL2 and L2 can be lowered to 4 V and 0 V respectively in a pulsed manner with a fall time of 100 ns and a duration of 100 μsec. After the duration of 100 μsec, the potentials TNL2 and L2 may be raised to their trapping potentials of 15 V and 25 V, respectively, and the process may be repeated. The pulses of ions thus produced are injected into a mass analyzer residing "downstream" from ion guide 220.

While electrodes 204*a* and 204*b* of ion guides 202 and 220 have been described as ring electrodes, in an alternative embodiment of those ion guides according to the invention, electrodes 204*a* and 204*b* may further be segmented electrodes as described with reference to FIG. 7. Such a stacked ring ion guide with segmented electrodes is depicted in FIG. 18.

Figure 18:
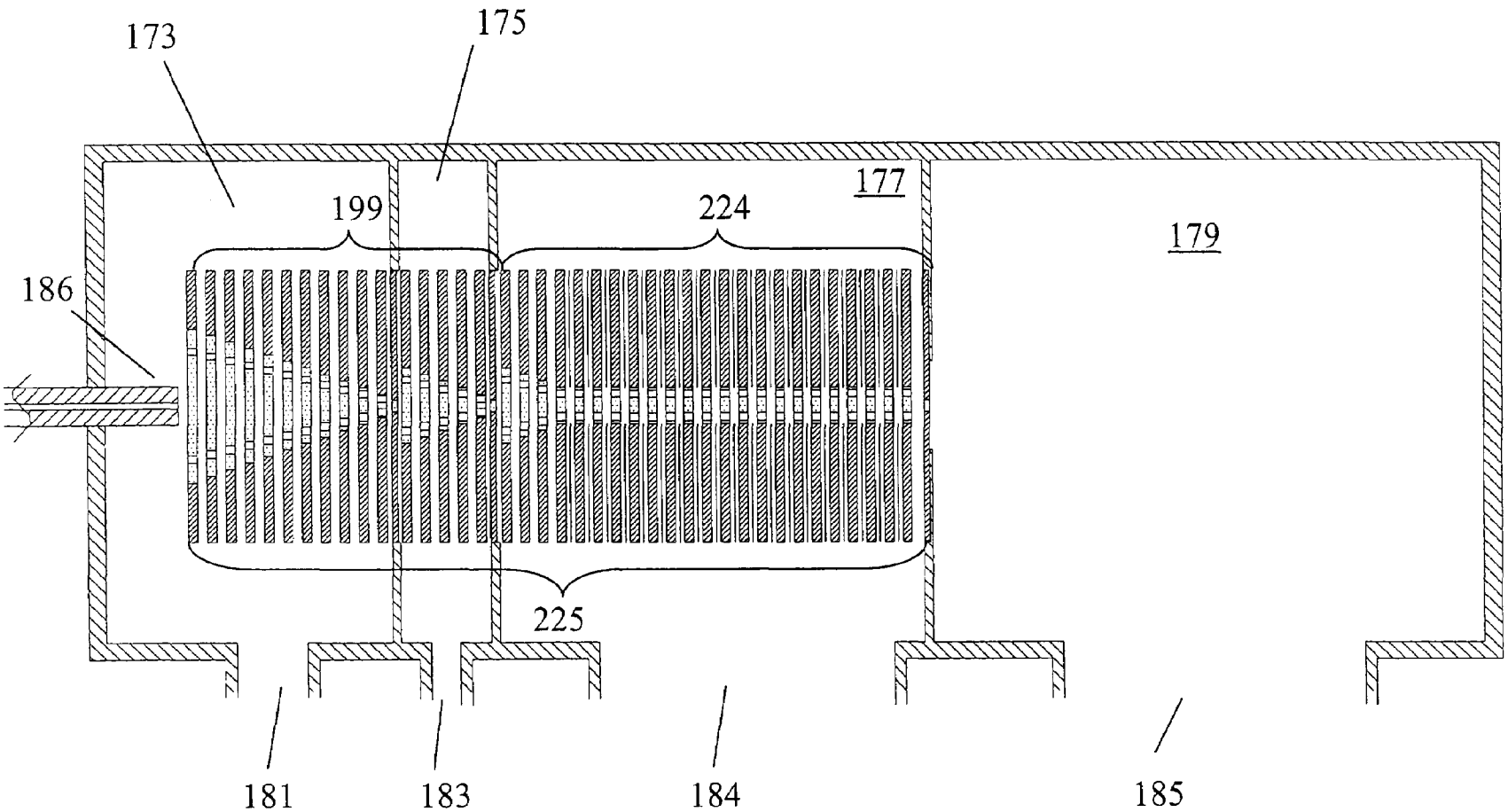
FIG. 18 depicts a cross-sectional view of a two-stage ion funnel and "funnel/stacked ring" ion guide in a vacuum system of a mass spectrometer.

FIG. 18 further depicts two-stage ion guide 199 used in conjunction with stacked ring ion guide 224, assembled together in the vacuum system of a mass spectrometer. The system depicted in FIG. 18 is identical to that of FIG. 13 with the exception of the replacement of ion guide 188 in FIG. 13 with stacked ring ion guide 224 in FIG. 18. As depicted in FIG. 18, two stage ion guide 199 can accept ions and focus them even at a relatively high pressure (i.e., in first pumping stage 173) and can efficiently transmit them through a second, relatively low pressure, differential pumping stage (i.e., chamber 175) to third chamber 177. With the addition of ion guide 224, the assembly has the advantage over prior art that ions can be trapped and rapidly ejected into chamber 179 and the mass analyzer residing therein. In alternate embodiments, ion guide 224 might extend through multiple pumping stages. In such a system, one or more of the electrodes 204 might also serve as pumping restrictions.

Figure 19A:
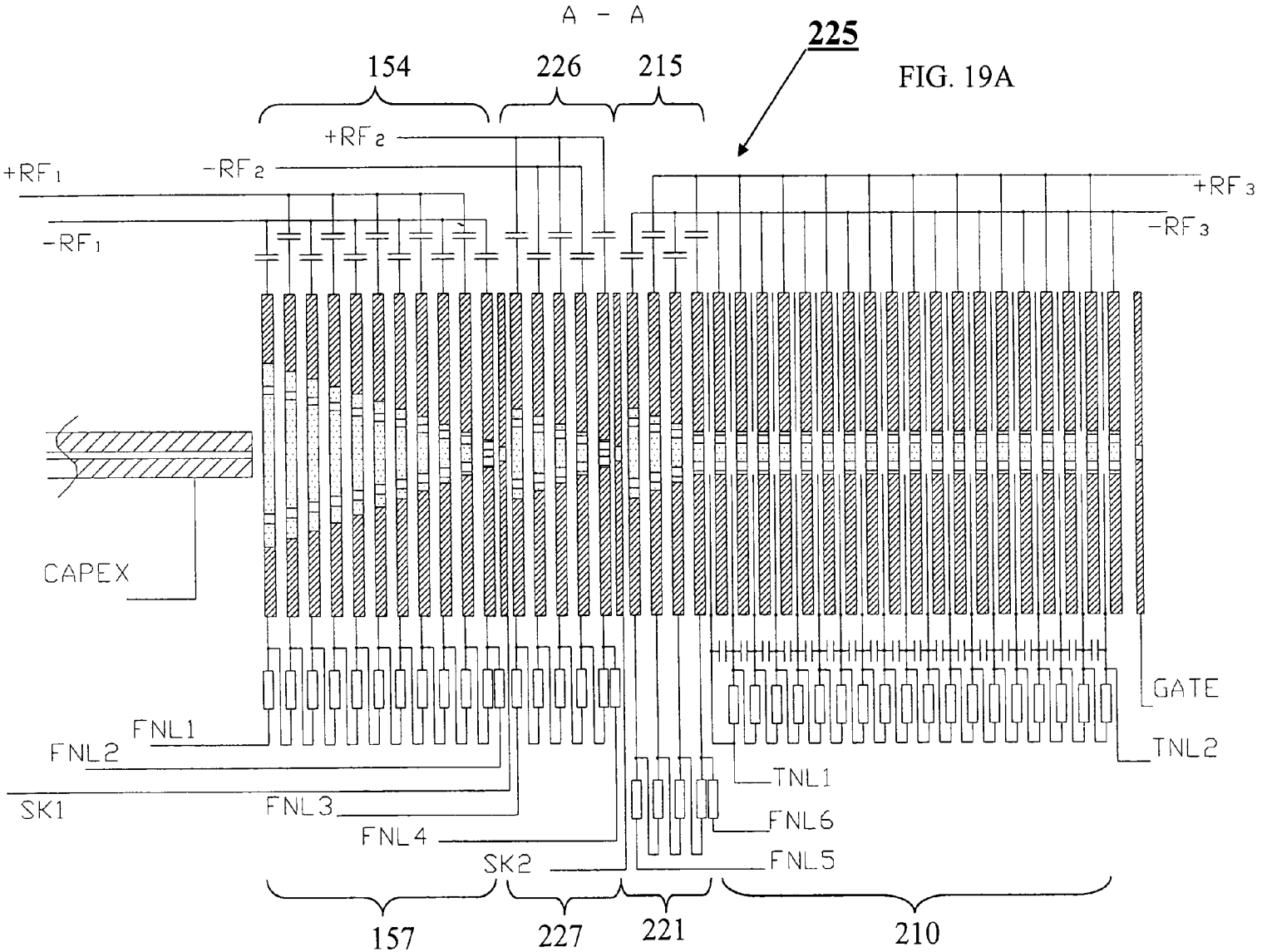
FIG. 19A shows a first cross-sectional view of the electrical connections to the "funnel/stacked ring" ion guide shown in FIG. 18.
Figure 19B:
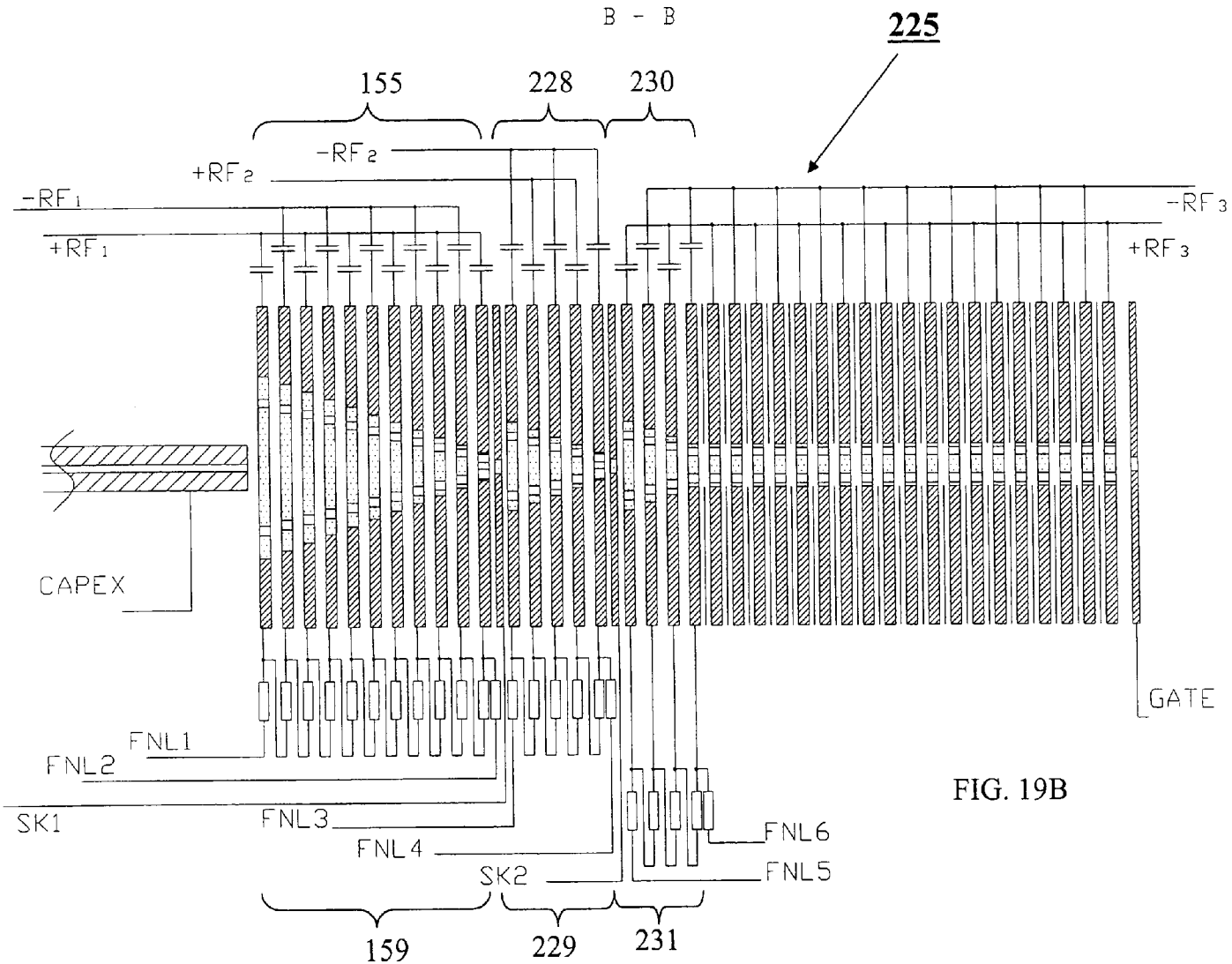
FIG. 19B is a second cross-sectional view, orthogonal to that of FIG. 19A, of the electrical connection to the "funnel/stacked ring" ion guide shown in FIG. 18.

Referring to FIGS. 19A-B shown are the electrical connections for ion guide 225 of FIG. 18. Specifically, FIG. 19A shows a first cross-sectional depiction of the electrical connections to ion guide 225 according to the present invention as depicted in FIG. 18. Next, FIG. 19B shows a second cross-sectional depiction, orthogonal to that of FIG. 19A, of the electrical connection to ion guide 225. As shown, ion guide 225 is electrically connected in a manner similar to that described above with respect to FIGS. 9, 14, and 16. In this embodiment, capacitors 154, 155, 215, 226, 228, and 230 all preferably have the same capacitance. Alternatively, the capacitance of capacitors 154 and 155 may differ from the capacitance of capacitors 226 and 228, as well as from that of capacitors 215 and 230. Similarly, resistors 157, 159, 221, 227, 229, and 231 are all preferably identical. However, in alternate embodiments, the resistance of these resistors may differ from one another. Also, in this embodiment, it is preferred that the RF potentials applied at $RF_1$, $RF_2$, and $RF_3$ be identical to one another. However, in alternate embodiments, the RF frequencies and/or amplitudes applied at inputs $RF_1$, $RF_2$, and $RF_3$ may differ from one another. Finally, it is preferred that the various DC potentials applied to the electrodes are such that the ions being transmitted are attracted toward the exit end of ion guide 225 and analyzer chamber 179. As discussed above, however, the inputs TNL1 and TNL2 of RC network 210 may be biased such that ions are either trapped in or ejected from that portion of ion guide 225.

Figure 20:
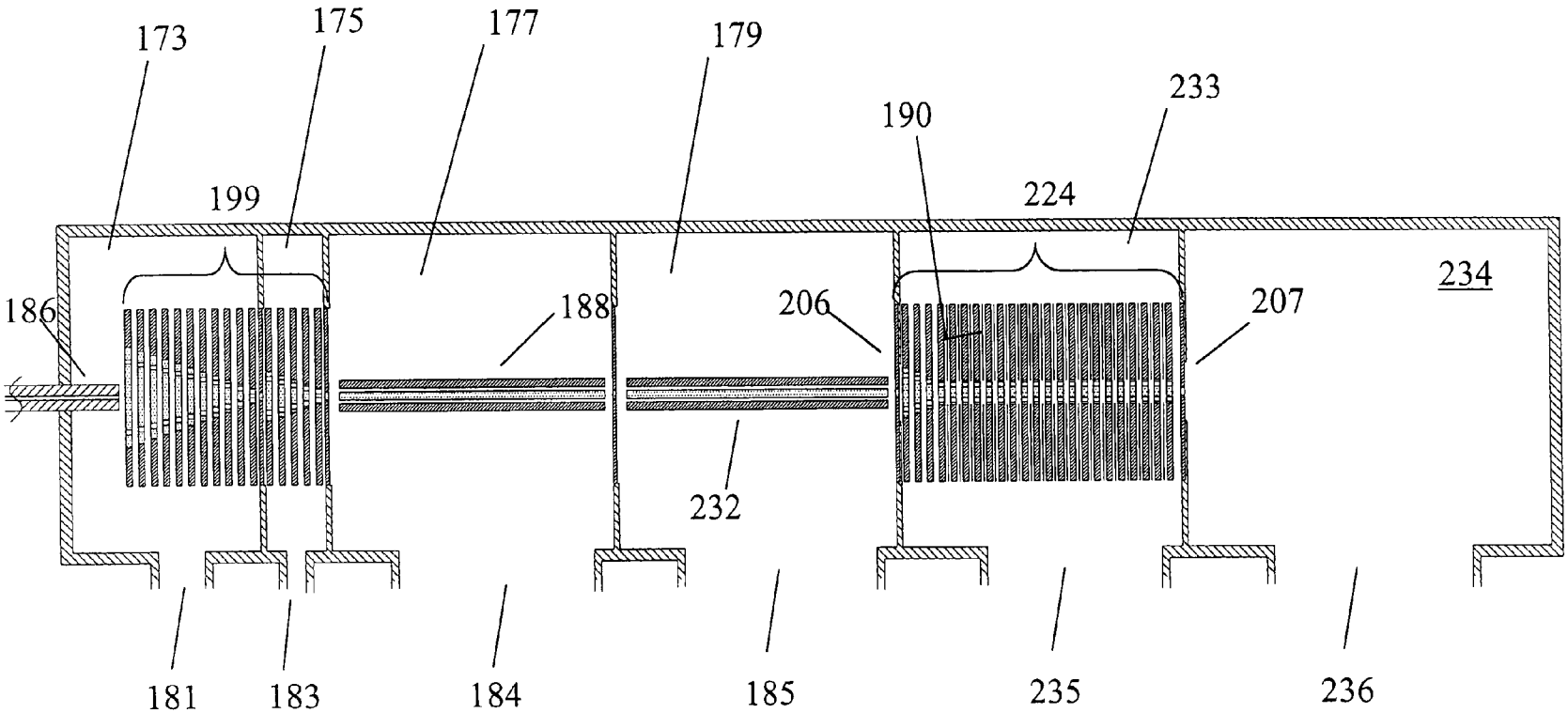
FIG. 20 depicts a cross-sectional view of an alternate configuration of the "funnel/stacked ring" ion guide of the present invention comprising multipoles placed between a two-stage segmented funnel ion guide and a funnel/stacked ring ion guides.

Yet another alternative embodiment of the present invention is shown in FIG. 20. In particular, shown are ion guides 199 and 224 positioned in the vacuum system of a mass spectrometer with two multipole ion guides 188 and 232 positioned there between. In the embodiment depicted in FIG. 20, the pressures in vacuum chambers 173, 175, and 177 and the operation of elements 186, 199, and 188 are substantially similar to that described with reference to FIG. 13. According to this embodiment, multipole ion guide 188 is a hexapole and multipole ion guide 232 is a quadrupole. As described above, an RF-only potential is applied to hexapole ion guide 188 so as to guide ions through chamber 177 and into chamber 179.

Preferably, chamber 179 is operated at a pressure of $10^{-5}$ mbar or less such that quadrupole 232 may be used to select ions of interest. It is also preferable that quadrupole 232 be used either to transmit substantially all ions or only selected ions through chamber 179 into chamber 233 and ion guide 224 positioned therein. As is well known from the prior art, substantially all ions will be transmitted through quadrupole 232 when an RF-only potential is applied to it. To select ions of interest, both RF and DC potentials must be applied.

Similar to that described above, selected ions are accelerated into chamber 233 and ion guide 224 via an electric field. The gas pressure of chamber 233 is preferably $10^{-3}$ mbar or greater. Typically the gas used is inert (e.g., Nitrogen or Argon) however, reactive species might also be introduced into the chamber. When the potential difference between ion guides 232 and 224 is low, for example 5V, the ions are simply transmitted therethrough. That is, the ions will collide with the gas in ion guide 224, but the energy of the collisions will be low enough that the ions will not fragment. However, if the potential difference between ion guides 232 and 224 is high, for example 100 V, the collisions between the ions and gas may cause the ions to fragment.

In this manner ion guide 224 may act as a "collision cell". However, unlike prior art collision cells, the funnel-like entrance of ion guide 224 allow for the more efficient capture of the selected "precursor" and "fragment" ions. Precursor and fragment ions may be trapped in the manner described above with reference to FIGS. 16 and 17. Through collisions with the gas, the ions may be cooled to the temperature of the collision gas, typically room temperature. These ions will eventually be ejected from ion guide 224 into chamber 234 where an additional mass analyzer (not shown) may be used to analyze both the precursor and fragment ions and produce precursor and fragment ion spectra. In alternate embodiments, any of the other ion guides disclosed herein, for example ion guide 152 shown in FIG. 10B, may be substituted for ion guide 224.

The mass analyzer in chamber 234 may be any type of mass analyzer including but not limited to a time-of-flight, ion cyclotron resonance, linear quadrupole or quadrupole ion trap mass analyzer. Further, any type of mass analyzer might be substituted for quadrupole 232. For example, a quadrupole ion trap (i.e., a Paul trap), a magnetic or electric sector, or a time-of-flight mass analyzer might be substituted for quadrupole 232.

Still referring to FIG. 20, while trapped in ion guide 224 the ions may be further manipulated. For example, as discussed by Hofstadler et al., an ion guide may operate at a predetermined pressure such that ions within such ion guide may be irradiated with light and thereby caused to form fragment ions for subsequent mass analysis. Selected ions are preferably collected in the ion guide 224 in a generally mass-inselective manner. This permits dissociation over a broad mass range, with efficient retention of fragment ions. In the embodiments of the present invention disclosed herein, it is preferred that the pressure in chamber 233 be relatively high (e.g., on the order of $10^3$-$10^6$ mbar). Irradiating ions in such a high pressure region results in two distinct advantages over traditional Infrared Multiphoton Dissociation (IRMPD) as exemplified in Fourier Transform Ion Resonance (FTICR) and Quadrupole Ion Trap (QIT) mass spectrometry. Under high pressures, collisions with neutrals will dampen the ion cloud to the center of ion guide 224 and stabilize fragment ions, resulting in significantly improved fragment ion retention. In addition, the fragment ion coverage is significantly improved, providing more sequence information.

Figure 21:
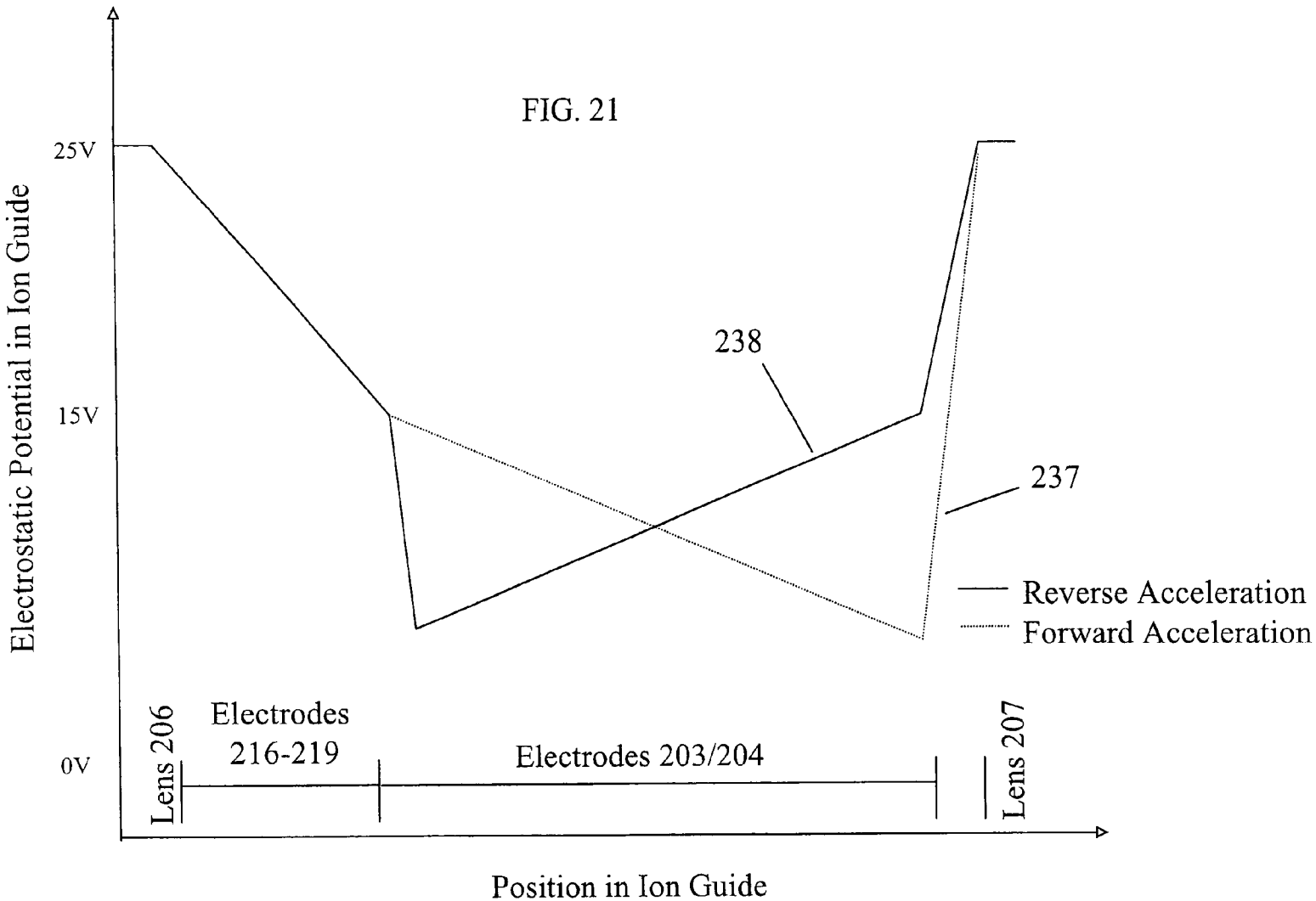
FIG. 21 is a plot of electric potential vs. position within the "funnel/stacked ring" ion guide according to the present invention with forward and reverse biasing.

Alternatively, ions might be activated toward fragmentation by oscillating the potentials on TNL1 and TNL2 (see RC network shown and described in reference to FIG. 16). As depicted in FIG. 21, ions may be accelerated back and forth within ion guide 224. When the potential applied at TNL1 (i.e., at lens 206) is held high relative to the potential applied at TNL2 (i.e., at lens 207) ions will be accelerated toward the exit end of ion guide 224 (i.e., toward chamber 234). As indicated by trace 237, the ions are prevented from escaping ion 224 by the RF on electrodes 204*a* and 204*b* and the repelling DC potential on lens electrode 207. Reversing the potentials applied at TNL1 and TNL2 results in a potential along the common axis of ion guide 224 represented by trace 238. The ions are then accelerated away from the exit end of ion guide 224 (i.e., at lens 207). In this situation, the ions are prevented from escaping ion guide 224 again by the RF potential on electrodes 204*a* and 204*b* and the repelling DC potentials on lens electrode 206 and ring electrodes 216-219. By rapidly alternating the forward and reverse acceleration of ions in guide 224 (i.e., by reversing the potentials applied at TNL1 and TNL2), the ions are caused to repeatedly undergo collisions with gas within ion guide 224. This tends to activate the ions toward fragmentation. At some predetermined time, the potentials on guide 224 will be brought back to that represented by trace 222 (seen in FIG. 17). At that time the ions will be cooled via collisions with the gas to the temperature of the gas. Then the ions will be ejected from ion guide 224 by applying potentials represented by trace 223 (seen in FIG. 17).

Figure 22:
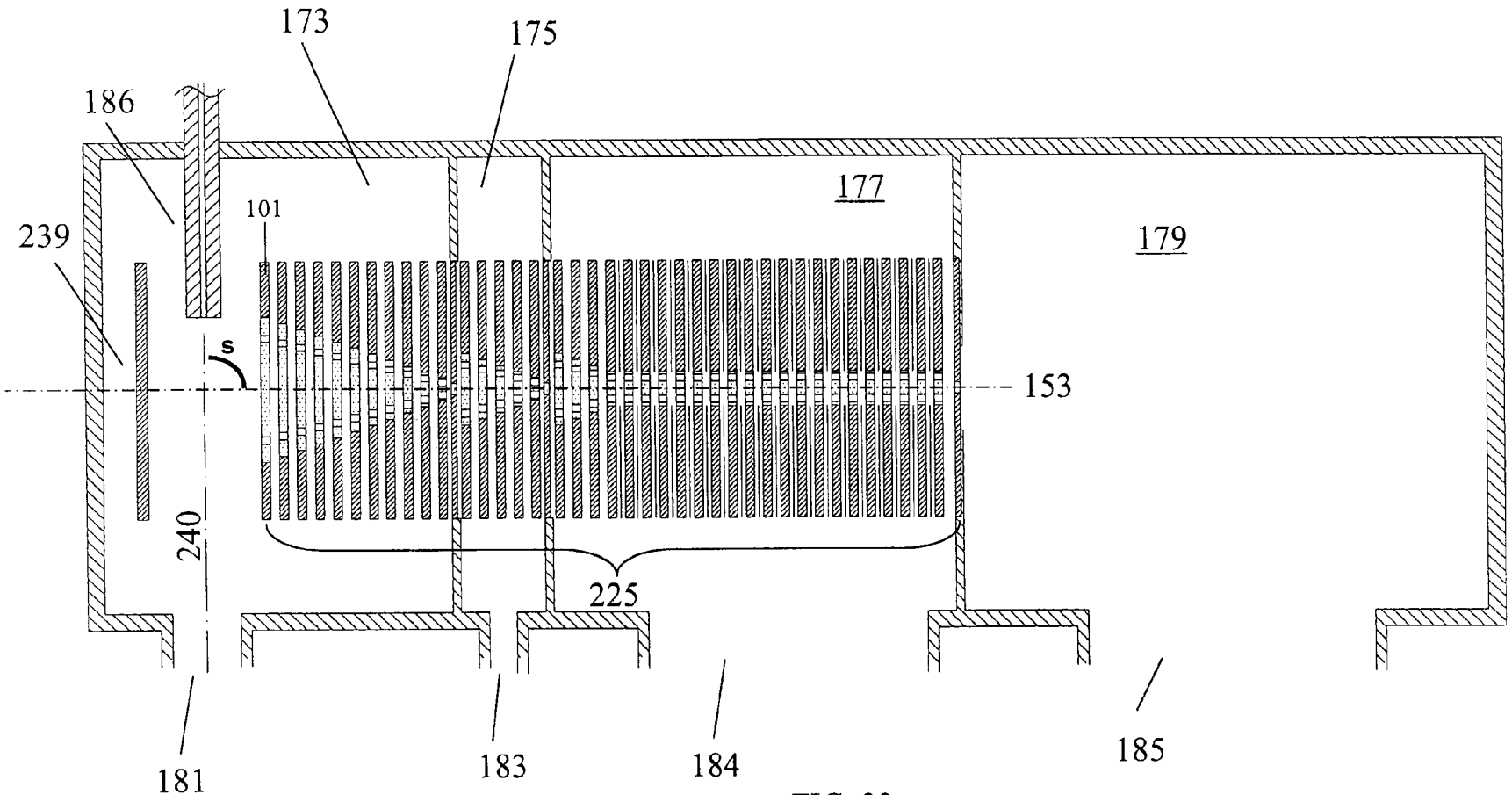
FIG. 22 depicts a cross-sectional view of a two-stage ion funnel and "funnel/stacked ring" ion guide in a system according to the present invention wherein the inlet orifice is oriented so as to introduce ions orthogonally into an ion guide.

Turning now to FIG. 22, depicted is a system according to another embodiment of the present invention wherein an ion guide according to one or more of the embodiments disclosed herein (e.g., ion guide 225 seen in FIG. 18) may be used with an orthogonal ion production means. That is, axis 240 of inlet orifice or capillary 186 is oriented so as to introduce ions orthogonal to axis 153 of ion guide 225. As discussed above, gas and ions are introduced from, for example, an elevated pressure ion production means (not shown) into chamber 173 via an inlet orifice or capillary 186. After exiting orifice or capillary 186 the directional flow of the ions and gas will tend to follow axis 240. Preferably, pumping port 181 is coaxial with inlet orifice or capillary 186 so that the gas, entrained particulates and droplets will tend to pass directly to port 181 and the corresponding pump. This is a significant advantage in that electrode 239 and ion guide 225 will not readily become contaminated with these particulates and droplets.

In this embodiment, electrode 239 is preferably a planar, electrically conducting electrode oriented perpendicular to axis 153. A repulsive potential is applied to electrode 239 so that ions exiting orifice or capillary 186 are directed toward and into the inlet of ion guide 225. The distances between potentials applied to elements 186, 239, and 225 may vary widely, however, as an example, the distance between axis 153 and orifice 186 in is preferably 13 mm, the lateral distance between axis 240 and the entrance of ion guide 225 is preferably 6 mm, and the distance between electrode 239 and the entrance of ion guide 225 is preferably 12 mm. The DC potentials on electrodes 101, 186, and 239 may be 100 V, 200 V, and 200 V respectively, when analyzing positive ions. As shown, angle $\alpha$ is 90° (i.e., orthogonal), but in alternate embodiments the angle $\alpha$ need not be 90° but may be any angle.

Figure 23:
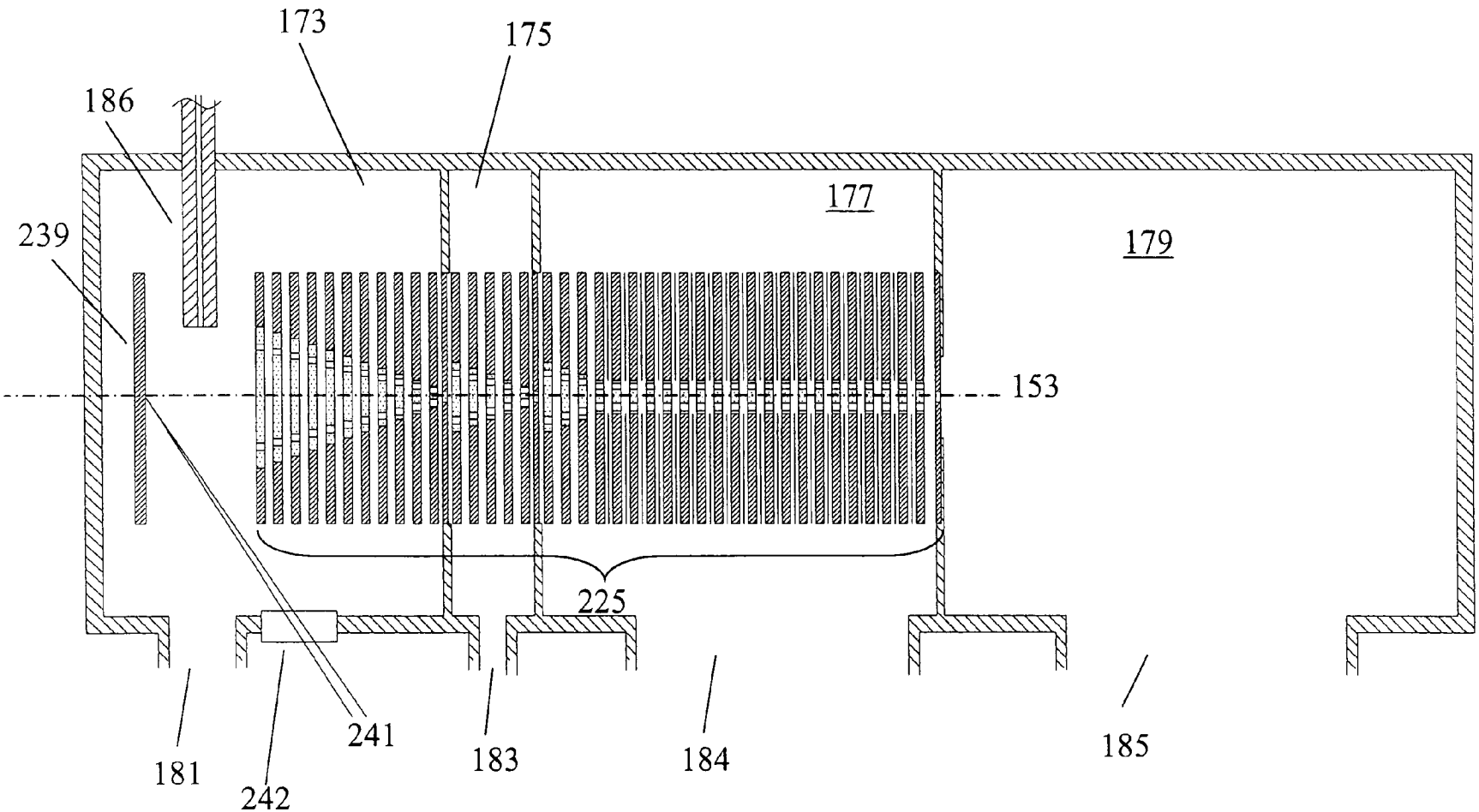
FIG. 23 shows the system according to the present invention as depicted in FIG. 22 wherein the deflection plate is used as a sample carrier for a MALDI ion production means.

Referring finally to FIG. 23, shown is the system depicted in FIG. 22 wherein electrode 239 is used as a sample carrier for a Matrix-Assisted Laser Desorption/Ionization (MALDI) ion production means. In this embodiment, electrode 239 may be removable or partly removable from the system via, for example, a vacuum interlock (not shown) to allow replacement of the sample carrier without shutting down the entire vacuum system. At atmospheric pressure, separate from the rest of the system, MALDI samples are applied to the surface of electrode 239 according to well known prior art methods. Electrode 239 now with samples deposited thereon (not shown) is introduced into the system via the above-mentioned vacuum interlock so that it comes to rest in a predetermined position as depicted in FIG. 23. Electrode 239 may reside on a "stage" which moves electrode 239 in the plane perpendicular to axis 153.

In this embodiment, window 242 is incorporated into the wall of chamber 173 such that laser beam 241 from a laser positioned outside the vacuum system may be focused onto the surface of electrode 239 such that the sample thereon is desorbed and ionized. On the sample carrier electrode 239, the sample being analyzed will reside approximately at axis 153. However, a multitude of samples may be deposited on the electrode 239, and as each sample is analyzed, the position of electrode 239 is change via the above-mentioned stage such that the next sample to be analyzed is moved onto axis 153. For this embodiment, any prior art laser, MALDI sample preparation method, and MALDI sample analysis method might be used.

During the MALDI analysis as described above, inlet orifice or capillary 186 may be plugged so that no gas, or alternatively a reduced flow of gas, enters chamber 173. Alternatively, one may produce ions simultaneously via a multitude of ion production means. For example, one might introduce ions from an electrospray ion production means via orifice 186 while simultaneously producing MALDI ions from samples on electrode 239. Though not shown, more than two ion production means might be used in this manner either consecutively or simultaneously to introduce ions into ion guide 225.

While the present invention has been described with reference to one or more preferred and alternate embodiments, such embodiments are merely exemplary and are not intended to be limiting or represent an exhaustive enumeration of all aspects of the invention. The scope of the invention, therefore, shall be defined solely by the following claims. Further, it will be apparent to those of skill in the art that numerous changes may be made in such details without departing from the spirit and the principles of the invention. It should be appreciated that the present invention is capable of being embodied in other forms without departing from its essential characteristics.

What is claimed is:

1. An ion guide for use in a mass spectrometer, said ion guide comprising:

a first set of apertured electrodes having a first potential applied thereto;

a second set of apertured electrodes having a second potential applied thereto;

first and second power sources for generating said first and second potentials, respectively, said power sources applying said potentials such that said ions may be selectively trapped in said ion guide or transmitted through said ion guide; and first and second apertured lens elements positioned at either end of said ion guide; wherein ions are introduced into an entrance end of said ion guide through said first lens element, and wherein each electrode of said second set of electrodes is positioned between two electrodes of said first set of electrodes.

2. An ion guide according to claim 1, wherein said first potential is a substantially RF-only potential.

3. An ion guide according to claim 1, wherein said second potential is a substantially DC-only potential.

4. An ion guide according to claim 1, wherein said first and second electrodes are aligned along a common axis.

5. An ion guide according to claim 4, wherein said ions are produced from an ion source positioned orthogonal to said common axis.

6. An ion guide according to claim 1, wherein at least one electrode of said first electrodes comprises alternating electrically insulating and electrically conducting regions.

7. An ion guide according to claim 1, wherein said first potential is a sinusoidally time-varying potential.

8. An ion guide according to claim 7, wherein said first potential applied to one of said first electrodes is 180° out of phase with said second potential applied to each adjacent said second electrode.

9. An ion guide according to claim 1, wherein said first and second potentials have a non-zero reference potential.

10. An ion guide according to claim 1, wherein said lens elements are maintained at a DC potential greater than said second potential.

11. An ion guide according to claim 1, wherein said ion guide begins in a region having a first pressure and ends in a region having a second pressure.

12. An ion guide according to claim 1, wherein said first and second potentials are applied via at least one network of resistors and capacitors.

13. An ion guide according to claim 12, wherein said network of resistors and capacitors is configured such that substantially RF-only potentials are applied to said first electrodes through said capacitors.

14. An ion guide according to claim 12, wherein said network of resistors and capacitors is configured such that electrostatic potentials are applied to said second electrodes through said resistors.

15. An ion guide according to claim 1, wherein said first electrode set comprises electrodes having a thickness greater than the thickness of electrodes of said second electrode set.

16. A method for analyzing a chemical sample, said method comprising the steps of:

generating ions from a sample;

introducing said ions into a first pressure region of a mass spectrometer; directing said ions into through a first lens element into an ion guide comprising a first set of apertured electrodes and a second set of apertured electrodes, wherein each electrode of said second set of electrodes is positioned between two electrodes of said first set of electrodes;

applying a first potential to said first electrode set via a first power source and second potential to said second electrode set via a second power source such that said ions are transmitted from a first pressure region into a second pressure region; and transmitting said ions from said second pressure region into a mass analyzer for subsequent analysis.

17. A method according to claim 16, wherein an electrostatic potential is applied to said second apertured electrode set as a function of said second apertured electrode set position along a common axis of said ion guide such that said electrostatic potential most repulsive to said ions is applied to electrodes of said second electrode set at an entrance end of said ion guide and said electrostatic potential most attractive to said ions is applied to electrodes of said second electrode set at an exit end of said ion guide.

18. A method according to claim 16, wherein said ions are produced from an ion source positioned orthogonal to said common axis.

19. A method according to claim 16, wherein said first and second potentials are applied via at least one network of resistors and capacitors.

20. A method according to claim 19, wherein said network of resistors and capacitors is configured such that substantially RF-only potentials are applied to said first electrode set through said capacitors.

21. A method according to claim 20, wherein said substantially RF-only potentials applied to one of said electrodes of said first electrode set is 180° out of phase with said substantially RF-only potential applied to each adjacent electrode of said first electrode set.

22. An ion guide for use in a mass spectrometer, said ion guide comprising:

a first set of apertured electrodes having an RF potential applied thereto;

a second set of apertured electrodes having a DC potential applied thereto;

RF and DC power sources for generating said RF and DC potentials, respectively, said power sources applying said potentials such that said ions may be selectively trapped in said ion guide or transmitted through said ion guide; and wherein ions are introduced into an entrance end of said ion guide, and wherein each electrode of said first set of electrodes is positioned between two electrodes of said second set of electrodes.

23. An ion guide for use in a mass spectrometer, said ion guide comprising:

a first set of apertured electrodes having a sinusoidally time-varying potential applied thereto;

a second set of apertured electrodes having a DC potential applied thereto;

time-varying and DC power sources for generating said time-varying and DC potentials, respectively, said power sources applying said potentials such that said ions may be selectively trapped in said ion guide or transmitted through said ion guide; and wherein ions are introduced into an entrance end of said ion guide, and wherein each electrode of said first set of electrodes is positioned between two electrodes of said second set of electrodes.

24. An ion guide according to claim 23, wherein said time-varying potential applied to one of said first electrodes is 180° out of phase with said time-varying potential applied to each adjacent said first electrode.

* * * * *